US007918591B2

(12) United States Patent
Lynch

(10) Patent No.: US 7,918,591 B2
(45) Date of Patent: Apr. 5, 2011

(54) LED-BASED LUMINAIRE

(75) Inventor: Manuel Lynch, Tustin, CA (US)

(73) Assignee: Permlight Products, Inc., Tustin, CA (US)

( * ) Notice: Subject to any disclaimer, the term of this patent is extended or adjusted under 35 U.S.C. 154(b) by 0 days.

(21) Appl. No.: 11/434,663

(22) Filed: May 15, 2006

(65) Prior Publication Data

US 2007/0041220 A1 Feb. 22, 2007

Related U.S. Application Data

(60) Provisional application No. 60/681,072, filed on May 13, 2005.

(51) Int. Cl.
*F21V 15/00* (2006.01)

(52) U.S. Cl. ... 362/365; 362/240; 362/800; 361/679.01; 361/807; 361/808; 361/809; 361/810; 361/823; 361/824; 257/99

(58) Field of Classification Search ..... 362/231, 362/240, 249, 365, 800; 257/99; 200/314; 361/679, 728, 807–810, 823–828
See application file for complete search history.

(56) References Cited

U.S. PATENT DOCUMENTS

| | | | | |
|---|---|---|---|---|
| 3,936,686 A | | 2/1976 | Moore | |
| 4,142,172 A | * | 2/1979 | Menard | 340/431 |
| 4,729,076 A | | 3/1988 | Masami et al. | |
| 4,855,882 A | | 8/1989 | Boss | |
| 4,866,580 A | | 9/1989 | Blackerby | |
| 5,107,408 A | | 4/1992 | Vernondier | |
| 5,217,296 A | | 6/1993 | Tanner | |
| 5,278,432 A | | 1/1994 | Ignatius et al. | |
| 5,296,310 A | | 3/1994 | Kibler et al. | |
| 5,313,187 A | * | 5/1994 | Choi et al. | 340/331 |
| 5,499,170 A | | 3/1996 | Gagne | |
| 5,607,227 A | | 3/1997 | Yasumoto et al. | |
| 5,635,814 A | * | 6/1997 | Afzal et al. | 320/111 |
| 5,785,411 A | | 7/1998 | Komai et al. | |
| 5,797,672 A | * | 8/1998 | Dobert | 362/190 |
| 5,857,767 A | | 1/1999 | Hochstein | |
| 5,863,467 A | | 1/1999 | Mariner et al. | |

(Continued)

FOREIGN PATENT DOCUMENTS

CN 1245521 A 2/2000

(Continued)

OTHER PUBLICATIONS

Hewlett Packard,Super Flux LED's. pp. 1-25, 1-26, and ii.

(Continued)

*Primary Examiner* — Sandra L O Shea
*Assistant Examiner* — Mary Zettl
(74) *Attorney, Agent, or Firm* — Knobbe, Martens, Olson & Bear, LLP.

(57) ABSTRACT

An LED-based luminaire includes a driver configured to convert line voltage into a desired power configuration. Elongate fasteners attach one or more LED-based lighting modules to a mount member and also to energized poles of the power driver. The fasteners communicate electrical energy from the power driver to the lighting module. In one embodiment, the mount member functions as a heat sink, and it includes a bumpy surface coating having a texture with sufficient feature heights to enhance heat transfer between the heat sink and the surrounding environment.

24 Claims, 20 Drawing Sheets

U.S. PATENT DOCUMENTS 5,958,572 A 9/1999 Schmidt et al.
6,042,248 A 3/2000 Hannah et al.
6,045,240 A 4/2000 Hochstein
6,056,420 A 5/2000 Wilson et al.
6,075,701 A 6/2000 Ali et al.
6,116,748 A 9/2000 George
6,131,651 A 10/2000 Richey, III
6,244,728 B1 6/2001 Cote et al.
6,249,267 B1 6/2001 Ishihara
6,250,774 B1 6/2001 Begemann et al.
6,283,612 B1 9/2001 Hunter
6,299,337 B1 10/2001 Bachl et al.
6,350,039 B1 2/2002 Lee
6,356,448 B1 * 3/2002 DiBene et al. ..... 361/721
6,367,949 B1 4/2002 Pederson
6,394,626 B1 5/2002 McColloch
6,412,971 B1 7/2002 Wojnarowski et al.
6,428,189 B1 8/2002 Hochstein
6,455,930 B1 9/2002 Palanisamy et al.
6,481,874 B2 11/2002 Petroski
6,483,254 B2 * 11/2002 Vo et al. ..... 315/241 S
6,485,160 B1 11/2002 Sommers et al.
6,502,968 B1 * 1/2003 Simon ..... 362/489
6,505,956 B1 1/2003 Priddy et al.
6,509,840 B2 1/2003 Martineau
6,514,616 B1 2/2003 Gandi et al.
6,517,218 B2 2/2003 Hochstein
6,528,954 B1 3/2003 Lys et al.
6,536,913 B1 3/2003 Yajima
6,548,967 B1 4/2003 Dowling et al.
6,566,824 B2 5/2003 Panagotacos et al.
6,573,536 B1 6/2003 Dry
6,578,986 B2 6/2003 Swaris et al.
6,582,100 B1 6/2003 Hochstein et al.
6,582,103 B1 6/2003 Popovich et al.
6,641,283 B1 11/2003 Bohler
6,648,496 B1 11/2003 Elghoroury et al.
6,659,622 B2 12/2003 Katogi et al.
6,660,935 B2 12/2003 Southard et al.
6,667,623 B2 12/2003 Bourgault et al.
6,700,136 B2 3/2004 Guida
6,712,486 B1 3/2004 Popovich et al.
6,717,526 B2 4/2004 Martineau et al.
6,739,047 B2 5/2004 Hammond et al.
6,758,573 B1 7/2004 Thomas et al.
6,787,999 B2 9/2004 Stimac et al.
6,796,698 B2 9/2004 Sommers et al.
6,799,864 B2 10/2004 Bohler et al.
6,815,724 B2 11/2004 Dry
6,846,093 B2 1/2005 Swaris et al.
6,871,983 B2 3/2005 Jacob et al.
6,880,952 B2 4/2005 Kiraly et al.
6,919,211 B1 * 7/2005 Fodor et al. ..... 436/518
7,081,645 B2 7/2006 Chen et al.
7,102,172 B2 9/2006 Lynch et al.
7,108,396 B2 9/2006 Swaris et al.
7,114,831 B2 10/2006 Popovich et al.
7,163,318 B2 1/2007 Panagotacos et al.
7,165,863 B1 1/2007 Thomas et al.
7,176,502 B2 2/2007 Mazzochette
7,183,640 B2 2/2007 Mazzochette
7,213,940 B1 5/2007 Van de Ven et al.
7,252,408 B2 8/2007 Mazzochette
7,267,461 B2 9/2007 Kan et al.
7,306,353 B2 12/2007 Popovich
7,329,024 B2 2/2008 Lynch et al.
7,344,280 B2 3/2008 Panagotacos et al.
7,387,406 B2 6/2008 Swaris et al.
7,497,596 B2 3/2009 Ge
7,513,639 B2 4/2009 Wang
7,628,512 B2 12/2009 Netzel, Sr. et al.
7,652,303 B2 1/2010 Galli
7,654,703 B2 2/2010 Kan et al.
7,676,915 B2 3/2010 Ter-Hovhannissian
7,679,096 B1 3/2010 Ruffin
7,722,220 B2 5/2010 Van De Van
2001/0029115 A1 * 10/2001 Sawayanagi ..... 439/34
2003/0063463 A1 4/2003 Sloan et al.
2003/0072117 A1 4/2003 Maekawa
2003/0112627 A1 * 6/2003 Deese ..... 362/249
2003/0174517 A1 9/2003 Kiraly et al.
2003/0184998 A1 * 10/2003 Collins ..... 362/184
2003/0218417 A1 11/2003 Chin
2003/0223235 A1 12/2003 Mohacsi
2003/0230934 A1 * 12/2003 Cordelli et al. ..... 307/43
2004/0066142 A1 4/2004 Stimac et al.
2004/0150954 A1 * 8/2004 Belady et al. ..... 361/704
2004/0188593 A1 9/2004 Mullins et al.
2004/0190305 A1 9/2004 Arik et al.
2004/0239243 A1 * 12/2004 Roberts et al. ..... 313/512
2005/0128751 A1 * 6/2005 Roberge et al. ..... 362/276
2005/0237005 A1 10/2005 Maxik
2005/0243552 A1 11/2005 Maxik
2005/0276083 A1 12/2005 Berghegger
2005/0285547 A1 12/2005 Piepgras et al.
2006/0044806 A1 * 3/2006 Abramov et al. ..... 362/337
2006/0072314 A1 * 4/2006 Rains ..... 362/231
2008/0055915 A1 3/2008 Lynch et al.
2008/0192462 A1 8/2008 Steedly
2009/0059595 A1 3/2009 Ge
2009/0086488 A1 4/2009 Lynch et al.

FOREIGN PATENT DOCUMENTS

EP 0921568 A2 6/1999
EP 1479286 A1 11/2004
WO WO 97/37385 1/1997
WO WO00/36336 6/2000
WO WO 02/36336 A1 6/2000

OTHER PUBLICATIONS

Thermal Management Considerations for Super Flux LEDs, Hewlett Packard, pp. 1-11.

Petroski, James, "Thermal Challenges Facing New Generation LEDs for Lighting Applications," in Solid State Lighting II, Proceedings of SPIE vol. 4776 (2002).

SloanLED: ChanneLED3 LED Lighting Solutions for Channel Letters.

Samuelson, Rick, et al., Power Systems Design Europe, *Thermal Management Made Simple*, Dec. 2005, The Bergquist Company, Chanhassen, Minnesota, 6 pages.

SloanLED: ChanneLED3 LED Lighting Solutions for Channel Letters, © 2003 SloanLED, 2 pages.

Petroski, James, Thermal Challenges Facing New Generation LEDs for Lighting Applications, in *Solid State Lighting II*, Proceedings of SPIE vol. 4776 (2002).

* cited by examiner

LED-BASED LUMINAIRE

RELATED APPLICATIONS

This application is based upon and claims the benefit of U.S. Application Ser. No. 60/681,072, which was filed on May 13, 2005, the entirety of which is hereby incorporated by reference.

BACKGROUND OF THE INVENTION

1. Field of the Invention

The present invention relates generally to light emitting diode (LEDs) based lighting devices, and more particularly to configurations for LED-based luminaires and for managing heat generated by LEDs in such luminaires.

2. Description of the Related Art

Conventional lighting applications typically employ incandescent or gas-filled bulbs. Incandescent bulbs typically do not have long operating lifetimes and thus require frequent replacement. Such bulbs also have substantially high power requirements. Gas-filled tubes, such as fluorescent or neon tubes, may have longer lifetimes, but operate using dangerously high voltages, and may contain toxic materials such as mercury.

In contrast, light emitting diodes (LEDs) are relatively inexpensive, operate at low voltage, and have long operating lifetimes. Additionally, LEDs consume relatively little power and are compact. These attributes make LEDs particularly desirable and well-suited for many lighting applications.

Lighting designers wishing to use LEDs often create LED-based luminaires that employ a plurality of LEDs in a "light bulb" type of arrangement such as that used with typical incandescent and some fluorescent lamps. By configuring LEDs to fit an arrangement specifically suited to old incandescent technology, such designs typically use such LEDs in a manner that compromises effectiveness and is unduly expensive.

SUMMARY OF THE INVENTION

Accordingly, there is a need in the art for LED-based lighting fixtures that are configured to maximize the lighting effectiveness of the LEDs, appropriately manage heat generated by the LEDs, and reduce the costs associated with such fixtures. There is also a need in the art for a simplified and standardized LED luminaire. There is a further need for an LED-based luminaire system including various componentry that can be mixed and matched as appropriate to custom-design luminaires for lighting applications using only standard components.

In accordance with one embodiment, the present invention provides a lighting apparatus comprising a lighting module, a mount member, and a power driver. The module has at least one light emitting diode (LED), a dielectric member, and a plurality of electrically conductive contacts disposed on the dielectric member. The contacts are configured to mount the at least one LED to supply electrical current to the LED. The mount member has a module receiving portion adapted to engage the lighting module. The power driver is arranged on a side of the mount member generally opposite the lighting module, and is adapted to receive power and condition the power to a desired state. At least one fastener is configured to engage the lighting module and the driver so as to secure the lighting module and driver onto the mount member. The fastener is electrically conductive, and conducts electric power from the driver to a contact of the LED module.

In another embodiment, the driver comprises connectors adapted to electrically and physically engage a pair of fasteners. The connectors are polarized and are substantially enclosed within a driver housing. In yet another embodiment, the mount member has a pair of mounting apertures adapted to accommodate the fasteners, and the fasteners physically and electrically engage positive and negative input contacts, respectively, of the lighting module.

In another embodiment, the present invention provides a lighting apparatus comprising alighting module and a mount member. The lighting module has at least one light emitting diode (LED), a dielectric member and a plurality of electrically conductive contacts disposed on the dielectric member. A positive input contact and a negative input contact are adapted to receive positive and negative electric power supplied thereto. The at least one LED is mounted to the electrically conductive contacts so that electric power flows between the positive and negative input contacts and across the LED. The mount member has a module receiving portion adapted to engage the lighting module. The mount member comprises a metal that is coated with a material that increases the surface area of the mount member relative to uncoated metal, and the coating material provides a visually bumpy-textured surface.

In another embodiment, the mount member is powder coated. In a still further embodiment, the powder coat is generally white.

In accordance with yet another embodiment, the present invention provides a lighting fixture comprising a mounting base, a lighting module and a power driver. The lighting module comprises at least one light emitting diode (LED), a positive contact, a negative contact, and a mount body, the at least one LED adapted to be powered by electric power flowing between the positive and negative contacts. The power driver is adapted to accept an input electric power and condition the input power to create a desired output electric power, and the driver comprises a pair of polarized connectors energized with the output electric power. A plurality of fasteners are adapted to electrically connect the positive and negative contacts to the polarized connectors. A light modifying apparatus is arranged adjacent the lighting module. A fixture housing at least partially encloses the lighting module, light modifying apparatus, and at least a portion of the base. The lighting module and driver are disposed on opposing sides of the mounting base, and the fasteners are adapted to physically connect the lighting module, driver, and mounting base.

In a yet further embodiment, a luminaire is adapted to be customized to a plurality of configurations. The luminaire comprises a lighting module, a mount member, and a power driver. The lighting module comprises a body, a plurality of electrically-conductive circuit traces, a positive and negative input trace each being configured to accept a positive and negative electrical input, respectively, and at least one light emitting diode (LED) attached to the traces so that electric power from the positive and negative input traces will flow through the LED. The mount member comprises a lighting module mounting portion and a fixture mount portion. The module mounting portion has a first pair of spaced apart mounting apertures and a second pair of spaced apart mounting apertures, each pair of mounting apertures being spaced a distance generally corresponding to a distance between the positive and negative input traces of the lighting module. The power driver is adapted to supply an output power to a pair of polarized output connectors. A pair of electrically-conductive fasteners are adapted to connect to the lighting module and power driver connectors so as to supply electric power from the polarized connectors to the positive and negative input traces of the lighting module. The driver and lighting module are attached to opposing sides of the mount member, and the fasteners extend through one of the first or second pairs of spaced apart mounting apertures of the mount member.

In a still further embodiment, the driver has a first footprint shape upon the mount member when the fasteners are disposed through the first pair of mounting apertures, and a second footprint shape upon the mount member when the fasteners are disposed through the second pair of mounting apertures, and the first and second footprint shapes are substantially the same. In still another embodiment, the lighting module comprises a plurality of LEDs, and a light pattern emitted by the lighting fixture when the module is fastened into place via the first pair of mount apertures is substantially different than a light pattern emitted by the lighting fixture when the module is fastened into place via the second pair of mount apertures.

In accordance with still a further embodiment, the present invention provides a channel illumination device. A metal casing of the device has a plurality of walls and a back. A plurality of lighting modules are arranged on the casing. Each lighting module comprises a body, a plurality of electrically-conductive circuit traces, a positive and negative input trace each being configured to accept a positive and negative electrical input, respectively, and at least one light emitting diode (LED) attached to the traces so that electric power from the positive and negative input traces will flow through the LED. The plurality of lighting modules are attached to at least one of the casing walls and back so that heat generated by the LEDs will flow through the module body and to the casing. A surface of the metal casing comprises a coating having a visibly bumpy surface texture so that the coated mount member surface has a greater average feature height than a surface that appears substantially flat.

Further embodiments can include additional inventive aspects, and apply additional inventive principles that are discussed below in connection with preferred embodiments.

DETAILED DESCRIPTION OF PREFERRED EMBODIMENTS

Figure 1:
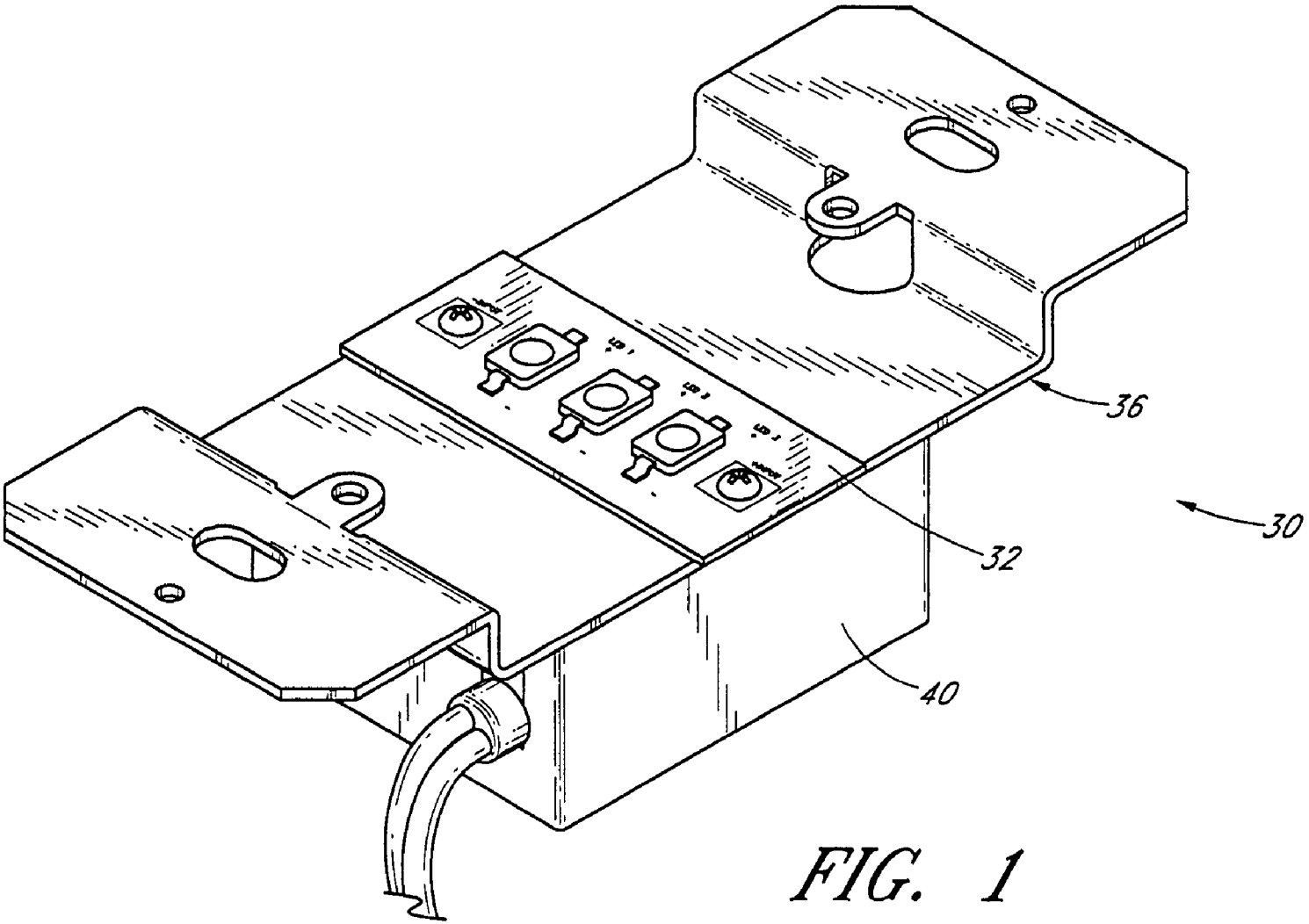
FIG. 1 is a perspective view of one embodiment of an LED luminaire having aspects of the present invention.
Figure 2:
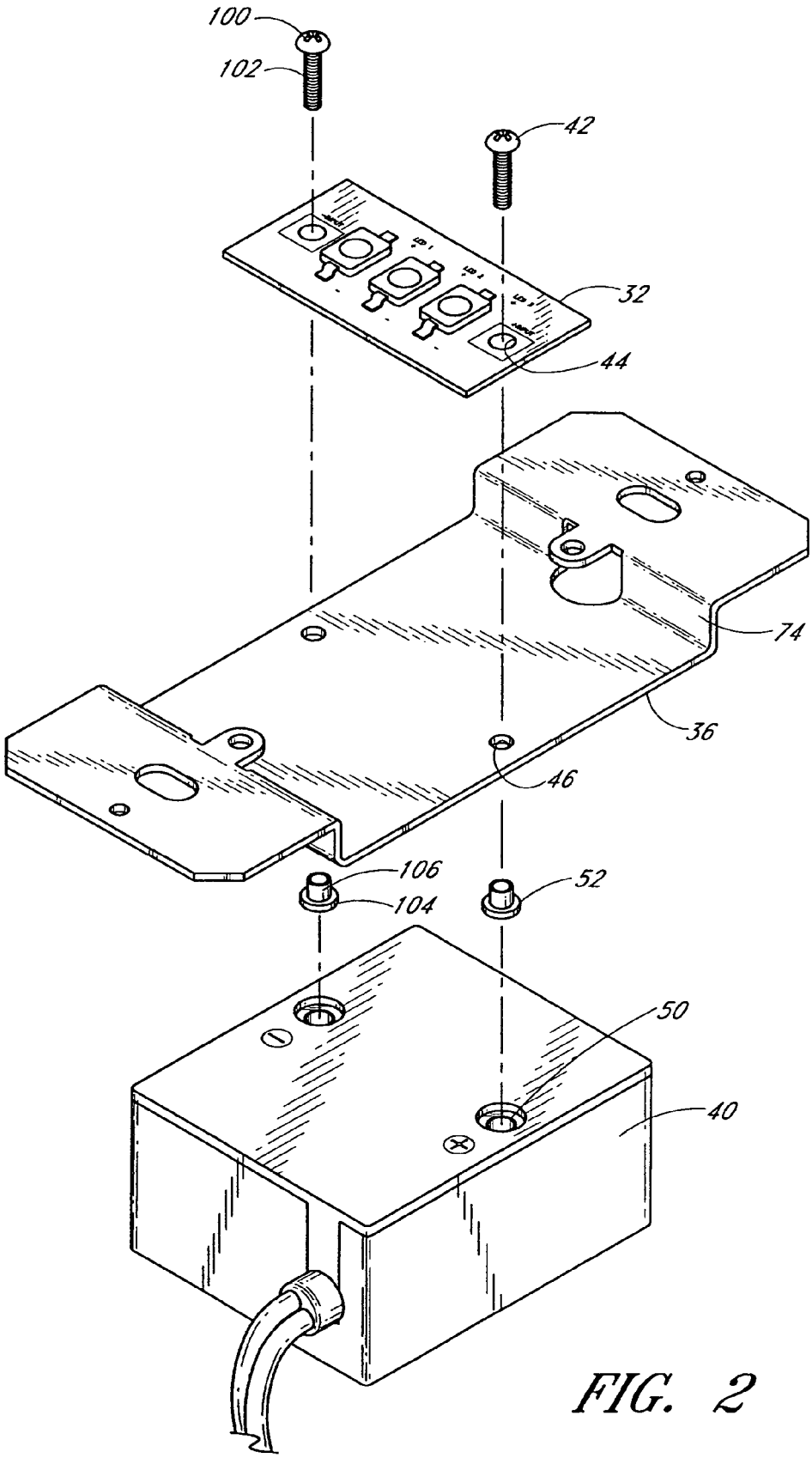
FIG. 2 is an exploded view of the embodiment of FIG. 1.

With reference first to FIGS. 1 and 2, an embodiment of a light emitting diode (LED)-based luminaire 30 is disclosed. Such an LED luminaire 30 can be used for retrofit and/or new installation purposes, and can be used independently or in connection with lighting fixtures, including standalone, hanging, wall- or ceiling-mounted, and other types of lighting fixtures. In the illustrated embodiment, the LED-based luminaire 30 comprises a lighting module 32 having one or more LEDs 34 disposed thereon, a mount member 36, and a power driver 40 for conditioning and delivering power to the lighting module.

In the illustrated embodiment, a pair of threaded fasteners 42 secure the lighting module 32 onto the mount member 36 and the driver 40. The fasteners 42 preferably extend through apertures 44, 46 formed through the lighting module 32 and mount member 36, and engage threaded mount bosses 50 in the driver 40. Non-conductive inserts 52 electrically insulate the mount member 36 and portions of the module 32 from the fasteners 42. Preferably, the mount bosses 50 in the driver 40 are polarized, which is to say a voltage drop is provided across the mount bosses 50. Further, preferably the fasteners 42 are configured to conduct electricity in addition to securing the lighting module 32 into place. As such, preferably electric power is communicated across the lighting module 32 via the fasteners 42, which contact the mount bosses 50 of the power driver 40.

Figure 3:
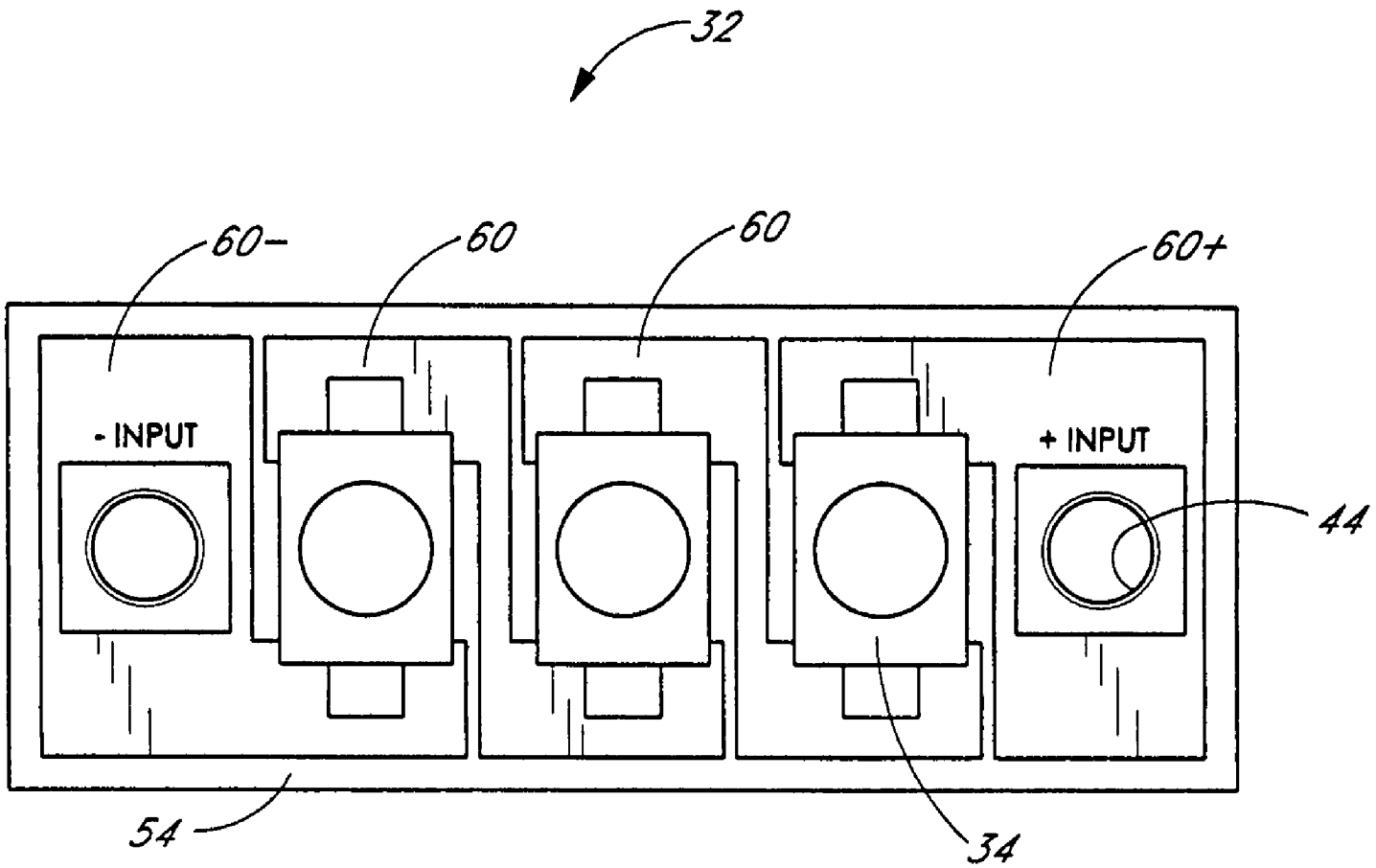
FIG. 3 is a top plan view of an LED module adapted for use in the embodiment of FIG. 1.

With additional reference to FIG. 3, an embodiment of a lighting module 32 preferably comprises a module body 54 upon which a plurality of electrically-conductive circuit traces/contacts 60 are deposited. Preferably, the contacts 60 are electrically insulated relative to one another. A pair of module apertures 44 are formed through the module body 54. Positive and negative input contacts 60+, 60− are formed at or adjacent the apertures 44. Preferably, a plurality of prepackaged LEDs 34 are mounted on the lighting module 32 so as to be arranged electrically in series between the positive 60+ and negative 60– input traces. In the illustrated embodiment, the lighting module 32 employs three LEDs arranged in series. Embodiments of a suitable lighting module include aspects as described in Applicant's co-pending U.S. patent application Ser. No. 10/928,910, entitled "LED Luminaire," which was filed on Aug. 27, 2004, the entirety of which is hereby incorporated by reference.

In the embodiment illustrated in FIG. 3, the lighting module 32 comprises three LEDs 34 arranged electrically in series between the positive and negative 60+, 60–. It is to be understood, however, that several different configurations of lighting modules can be employed depending on the application or a user's preference. For example, only a single LED, or several LEDs, may be provided on each lighting module. In additional embodiments, LEDs may be arranged on the module in a parallel arrangement, or a combination of series and parallel.

The rectangular geometry of the illustrated embodiment is especially suitable for the illustrated luminaire embodiment 30 discussed herein. It is to be understood, however, that other embodiments may benefit from differing module configurations. For example, it is contemplated that modules may be square, circular, oval, irregularly-shaped or may have widely varying rectangular dimensions (such as being especially long and thin). Additionally, although the illustrated modules are relatively flat, it is understood that other embodiments may include modules having simple or complex three dimensional shapes.

With continued reference to FIG. 3, the body 54 of the lighting module 32 can be made of various materials, rigid or flexible. However, most preferably, the body comprises a generally rigid heat conductive material such as aluminum. Preferably, the body 54 is constructed of a material having high heat conductance properties such as a heat conductivity greater than about 75 W/m*K and most preferably greater than about 100 W/m*K. As such, the body will absorb heat generated by the LEDs, and will draw the heat away from the LEDs.

Further, the LEDs 34 may be all the same color, may be of different colors, or may include combinations of LED colors that are specifically tailored to create a particular color effect. For most space lighting applications the LEDs preferably emit white light.

Figure 4:
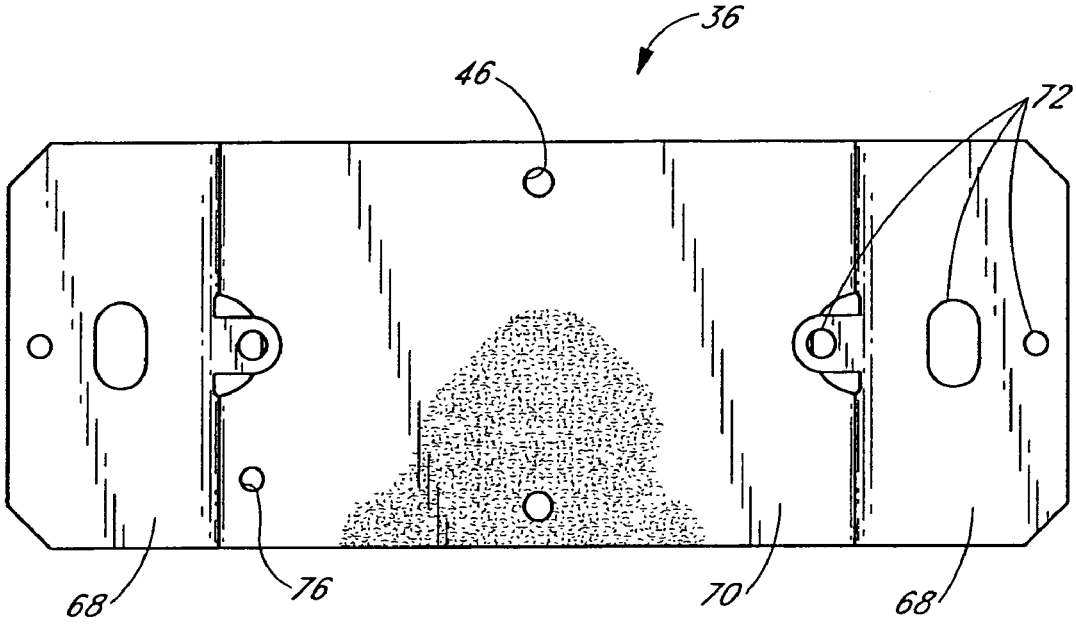
FIG. 4 is a plan view of a mount member suitable for use in the embodiment of FIG. 1.

With reference also to FIG. 4, the illustrated mount member 36 preferably is elongate and comprises fixture mount surfaces 68 arranged on opposite sides of a module mounting field 70 that is located generally centrally in the mount member 36. Mount apertures 46 are formed in the mount field 70 and are adapted to generally align with module apertures 44 formed in the module 32. The elongate fasteners 42 are adapted to extend through both the module apertures 44 and the mount apertures 46 to secure the module 32 in place on the mount field 70.

The mounting field 70 preferably is substantially flat so as to complement the flat body 54 of an associated lighting module 32. In other embodiments, the lighting module may have an irregular or curving surface that preferably is configured to complement the lighting module body surface. As such, heat is readily transferred from the lighting module body 54 to the mount member 36. Preferably, the mount member is made of a material having relatively high heat conductance properties, such as metal. In the illustrated embodiment, the mount member 36 is constructed of a single piece of aluminum.

One or more fixture mount apertures 72 preferably is disposed in each of the fixture mount portions 68 of the mount member. One or more of these fixture mount apertures 72 preferably is employed to secure the mount member 36 to its designated location. More specifically, for example, the fixture mount apertures 72 may align with bolt or screw holes in an electrical junction box or the like so as to enable mounting of the mount member 36 in an electrical junction box. In additional embodiments, one or more of the fixture mount apertures 72 corresponds with mounting bolts of another type of lighting fixture. It is to be understood that, in other embodiments, the mount member may have other shapes and configurations so as to fit as desired relative to a lighting fixture so as to provide the light source for the lighting fixture.

In the embodiment illustrated in FIGS. 2 and 4, the mount member 36 is bent to create a transversely-directed offsetting portion 74 between the fixture mount portion 68 and the mounting field portion 70 of the mount member 36. Thus, the mounting field 70 is offset from the fixture mount portion 68. In some embodiments, the offset 74 provides a space for the lighting module 32 to be mounted to the mount field 70 in a fixture embodiment in which a face of the fixture is substantially flush with the fixture mount portion 68. Preferably one or more ground apertures 76 are provided in the mount member for supplying a connection to electrical ground when desired.

In the illustrated embodiment, heat from the LEDs on the lighting module 32 is communicated to the heat conductive module body 54, which in turn communicates the heat to the mount member 36. The mount member acts as a heat sink, absorbing the heat from the lighting module and thus communicating heat away from the LEDs 34. Since LEDs tend to deteriorate very quickly if subjected to excessive heat, the mount member's operation as a heat sink can provide a valuable role in ensuring longevity of an associated LED luminaire. The mount member 36, which functions as a heat sink, preferably accumulates heat and disperses such heat to the environment.

In the illustrated embodiment, the mount member 36 is formed of aluminum and is powder coated. Most preferably the powder coat is a glossy white color and has a rough or bumpy surface texture. In a preferred embodiment, the overall surface area of the mount member is increased significantly by the bumpy powder coat relative to flat metal. In one embodiment, the overall surface area due to the rough-textured powder coat is increased by up to about three times relative to a smooth flat metal surface. In another embodiment, the surface area is at least about doubled.

Coating the mount member 36 with a bumpy-textured coating may not always vary the surface area extensively. However, changing the surface texture of the raw metal increases its heat transfer properties. For example, in some embodiments the mount member may be a polished or unpolished aluminum. Application of a covering such as a visibly bumpy-surface powder coat changes the surface texture of the device. Applicants have learned that adding a rough surfaced, bumpy powder coat to a raw or polished aluminum mount member improves the heat conductivity properties of the mount member. Specifically, Applicant has measured temperature decreases between about 30-50% when a bumpy white powder coated mount member heat sink is used in place of a raw metal mount member heat sink. Applicant has also noted improved heat conductance properties and decreased measured temperatures relative to raw metal even when the mount member is powder coated with a relative smooth powder coat. Most preferably, the mount member is coated with a light-and heat-reflective color, such as gloss or semi-gloss white; however, other colors may be used.

With continued reference to FIG. 4, preferably the mount member 36 is coated with a coating having a visibly bumpy texture. The bumpy texture creates many peaks and valleys in the surface. A feature height is defined as a height of a peak relative to its adjacent valley. An average feature height is, of course, an average of such measurements, and gives an indication of the bumpiness of the surface.

In the illustrated embodiment, the bumpy powder coating does not simply increase the surface area of the mount member relative to raw metal. Rather, the bumpy powder coating increases the average feature height of the surface of the mount member. Most preferably, the coating is configured to increase the average feature height so as to increase incident air access to and interaction with the peaks and valleys that make up the bumpy surface. Such increased incident air interaction increases the ability of the environmental air to extract heat from the mount member.

It is noted that some raw metals, such as aluminum, may appear generally flat to the human eye, but in fact include several peaks and valleys having a relatively low average feature height. A bumpy powder coat may not necessarily increase the surface area of such a raw metal substantially. However, the bumpy powder coat preferably increases the average feature height significantly, and thus increases the ability of the mount member to transfer heat to the environment, relative to a mount member having an uncoated metal surface. The increased average feature height increases the efficiency of heat transfer relative to unfinished aluminum.

In certain embodiments, the LEDs 34 of the lighting module 32 emit white light. In current white LED technology, especially "warm" white LEDs, which resemble incandescent white light in color, the LED package includes red phosphors. As such, a spectral distribution curve of the warm white light emitted by such LEDs shows a significant amount of infrared light in the spectrum. Such infrared light readily communicates energy to whatever material it impinges upon, which energy typically is converted to heat within the material. If a mount member were untreated, or were colored black as are conventional heat sinks, such infrared light energy would increase the temperature of the heat sink, thus diminishing its effectiveness as a heat sink. A light-reflective color such as gloss or semi-gloss white, reflects infrared light rays as well as other colors of light, and thus minimizes the accumulation of infrared light energy by the heat sink. Thus, light energy from the infrared light is not transferred to the heat sink, but rather is directed to the environment. As such, the effectiveness of the heat sink in extracting heat from the LEDs is enhanced, as less energy is being absorbed by the heat sink. As such, preferably the light-reflective coating is applied even in areas of the device that are not visible to the outside or to a user looking at the device.

Typically heat sinks are painted black in order to better absorb heat. However, as discussed above, in contrast to conventional practice, the mount member, which functions as a heat sink, preferably is painted a light-reflective color. In this lighting-based application, the light-reflective heat sink has increased capacity relative to a conventional black or otherwise low-reflectivity heat sink. In one embodiment, a visibly bumpy-surfaced semi-gloss white powder coat is employed. One suitable powder coat is a polyester TGIC powder coating (TC 13-WH09), which is available from Cardinal Industrial Finishes.

Figure 5A:
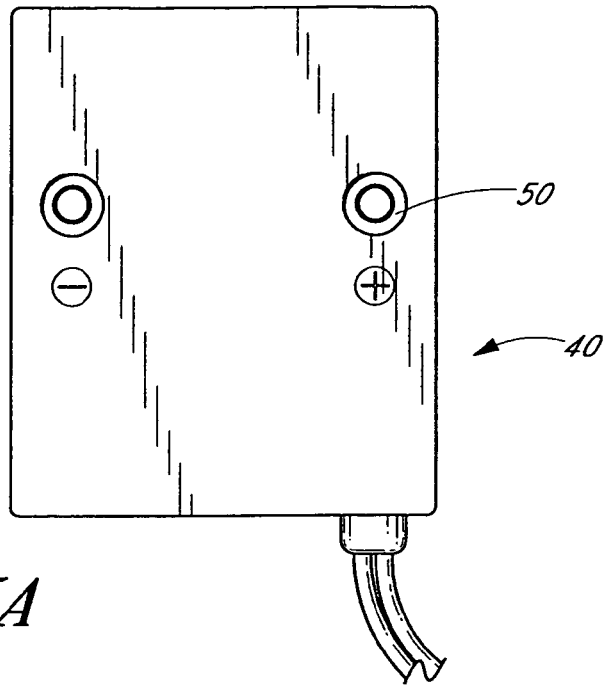
FIG. 5*a* is a front view of an embodiment of a power driver suitable for use with the embodiment of FIG. 1.
Figure 5B:
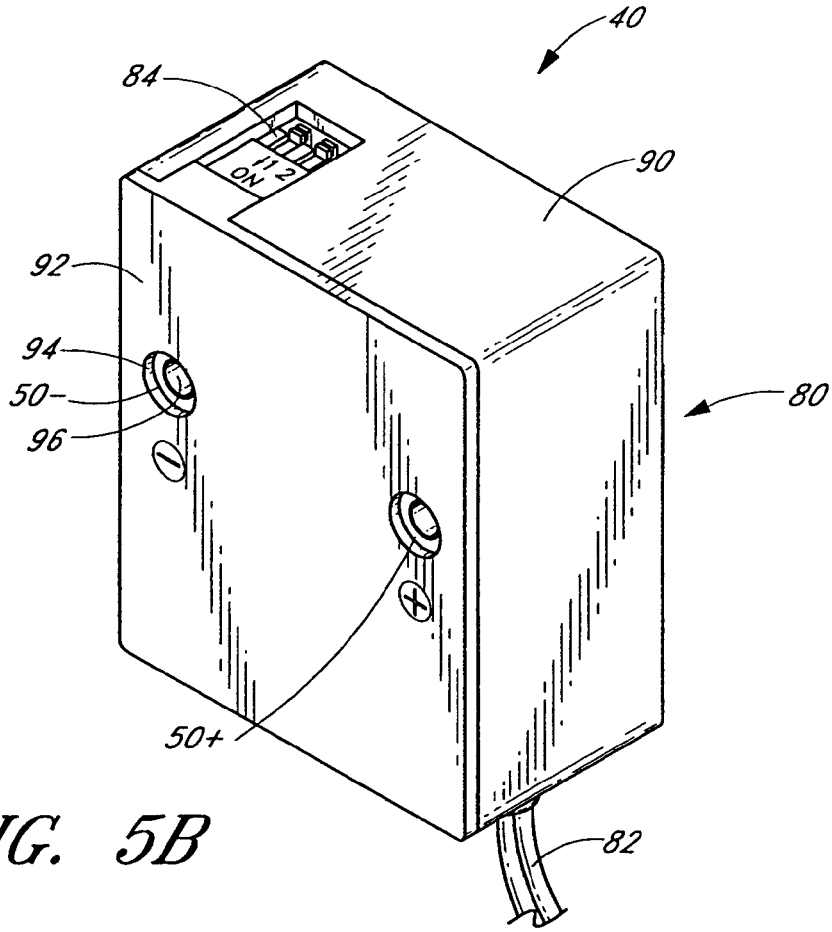
FIG. 5*b* is a perspective view of the power driver of FIG. 5*a*.

With additional reference to FIGS. 5*a* and 5*b*, the power driver 40 comprises a housing 80 that encloses electrical components and circuitry for power conditioning. A pair of flexible conductors 82 are configured to connect to line voltage such as 120 VAC and to communicate such line voltage to the driver componentry. The componentry within the driver 40 steps down the voltage and rectifies it into a DC voltage that is appropriate for driving the LEDs 34 on the module 32. For example, in the illustrated embodiment, the voltage is stepped down to 6-10 volts.

As shown specifically in FIG. 5*b*, preferably a switching mechanism 84 is provided to customize the power conditioning desired by the user. For example, the user may choose low, medium, and high brightness settings. The componentry and circuitry within the power driver 40 preferably is configured so that when each switching configuration (switches 1 and 2 are both off; 1 is on, 2 is off; 1 is off, 2 is on; or 1 and 2 are both on) is associated with a configuration of the circuit that results in a different brightness or control setting, resulting in different power supply characteristics being provided to the lighting module. More specifically, the associated circuitry and/or a control system within the housing, is configured to vary the voltage, current supply, duty cycle, or the like as needed in accordance with known principles and componentry. In additional embodiments, electrical componentry of the driver 40 can resemble that discussed in connection with another embodiment discussed below.

With continued reference to FIGS. 5*a* and 5*b*, mounting bosses 50 are arranged within the driver 40, and are configured to align with the lighting module apertures 44 and mount member apertures 46 so that the elongate fasteners 42 extending through the apertures engage the mounting bosses 50. The mounting bosses are polarized, meaning that there are configured as part of a circuit path so that when a module 32 is properly installed it bridges from a positive to a negative boss, 50+, 50– thus completing a circuit and supplying electrical power to the module 32. In the illustrated embodiment, the mount bosses 50 are threaded so as to engage threads of the elongate fasteners 42. Electric power is communicated through the mounting bosses to the fasteners and from the fasteners to the positive and negative circuit traces 60+, 60– formed on the lighting module 32, and in turn through the LEDs 34.

As illustrated, preferably all electronic componentry, including the mounting bosses 50, is generally enclosed within the housing 80. The housing includes an outer case 90 and a front plate 92 that complementarily engage one another. Apertures 94 are formed through the plate 92 so as to correspond with the mounting bosses 50. Preferably, the plate apertures 94 are somewhat larger in diameter than the threaded engagement portion 96 of the mount bosses 50. Preferably positive and negative legends are embossed on the plate 92.

With particular reference again to FIG. 2, the exploded view shows how the lighting module 32, mount member 36, and power driver 40 preferably are connected to one another. As shown, preferably the lighting module 32 is on one side of the mount member 36 and the power driver 40 is on the opposite side of the mount member 36. The fasteners 42 each comprise a head portion 100 and a threaded elongate shaft portion 102 which extends through the associated module aperture 44 and mount aperture 46 and engage the corresponding mount boss 50. The fastener heads 100 engage the corresponding positive or negative input trace 60+, 60– of the module. When the fasteners are tightened, the mount member 36 is sandwiched between the lighting module 32 and power driver 40.

With continued reference to FIGS. 1 and 2, and as discussed above, the mount bosses 50 are polarized and the fasteners 42 preferably are electrically conductive. As such, the heads 100 of the electrically-conductive fasteners communicate electrical power from the driver bosses 50 to the positive and negative input traces 60+, 60– of the module. A pair of non-conductive inserts 52 are provided to electrically insulate the fasteners 42 from the mount member 36 and body portion 54 of the lighting module 32. Each insert 52 preferably comprises a flange portion 104 and a shank portion 106. The shank 106 is configured to fit through the mount member aperture 46 and at least part of the module aperture 44, and accepts part of the corresponding threaded fastener 42 therethrough. Since the inserts 52 are electrically nonconductive, the inserts electrically insulate the threaded fasteners 42 from the mount member 36 and the body 52 of the lighting module 32. The flanges 104 of the inserts 52 preferably are configured to fit within the housing plate 92 apertures 94 so as to maintain the position of the inserts 52 without interfering with the position of the mount member 36 upon the driver 40.

Figure 6:
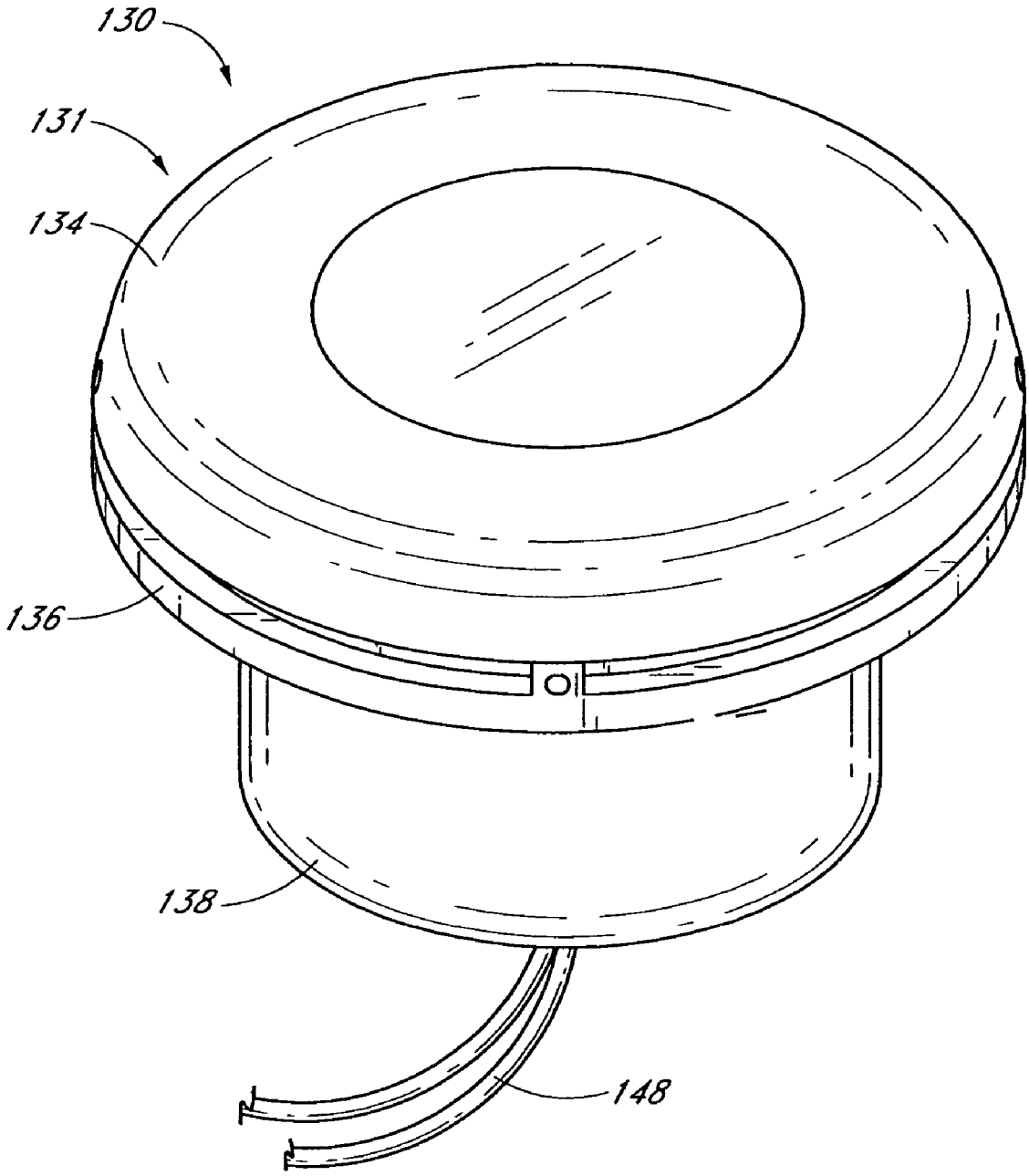
FIG. 6 is a perspective view of another embodiment of an LED-based luminaire having aspects of the present invention.

With reference next to FIG. 6, another embodiment of an LED-based luminaire 130 is illustrated. This figure shows an entire standalone light fixture 131 that is adapted to be connected to standard home 120 VAC wiring. Of course in other embodiments other supply voltage configurations can be considered, such as 240 vac. In the illustrated embodiment, the fixture 131 comprises a cover 134 attached to a mounting base 136. A back housing 138 is also provided. A power conditioning device 140 within the back housing 136 is preferably enclosed.

Figure 7:
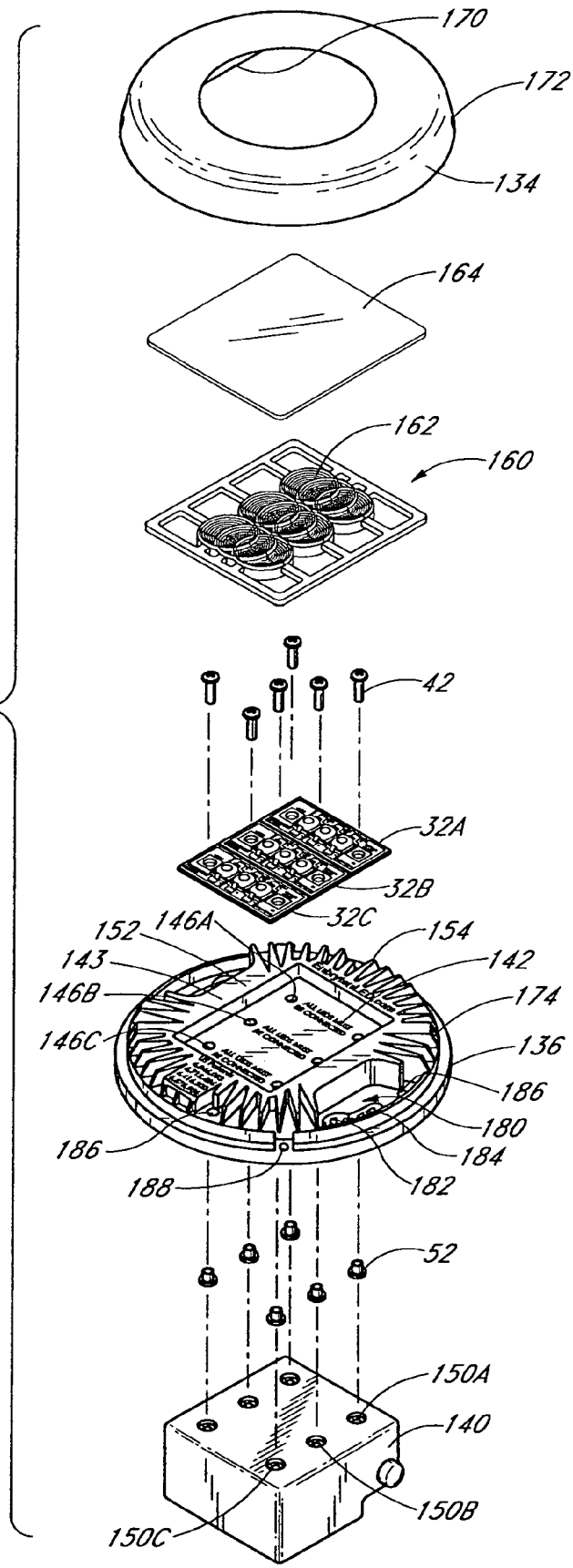
FIG. 7 is an exploded view of the embodiment illustrated in FIG. 6.

FIG. 7 presents an exploded view of the embodiment illustrated in FIG. 6 but not showing the back housing. As shown, the illustrated embodiment 130 employs three LED-based lighting modules 32A-C that are configured to fit in a module mounting portion 142 of the mount base 136. The module mounting portion 142 is specifically configured to accommodate all three modules 32A-C. As shown, the module mounting portion 142 of the base 136 is offset from a front surface 143 of the base so that the lighting modules are offset inwardly relative to the front surface 143. Additionally, the mounting portion 142 is shaped so as to complement the shape of the lighting modules 32A-C. In the illustrated embodiment, the module mounting portion 142 is substantially rectangular and flat-surfaced so as to complementarily accommodate the lighting modules. Module apertures 44 are formed through each lighting module 32, and three pairs of mounting base apertures 146A-C are formed through the mounting base 136 in the mount portion 142 to correspond with the module apertures 44.

A power conditioner or driver 140 is configured to be placed on a side of the mount base 136 opposite the lighting modules 32. In the illustrated embodiment, the power driver 140 receives electrical input power from a power source through electrical wires 148. The driver 140 also comprises three pairs of mounting bosses 50A-C. Each pair of mounting bosses 50A-C is configured to power a corresponding lighting module 32A-C. Preferably, threaded fasteners 42 are configured to fit through the lighting module apertures 44, mounting base apertures 146, through an insert 52, and into secure contact with corresponding mount bosses 50A-C of the power driver 140 in a manner as discussed above. Thus, the fasteners 42 secure the lighting modules 32A-C and power driver 140 to the mounting base 136, and the fasteners 42 also deliver electrical power from the driver bosses 50A-C to corresponding modules 32A-C.

The mounting base 136 is preferably formed from a material having advantageous heat conductance properties, such as aluminum. As such, the mounting base may operate as a heat sink, absorbing heat generated by the LEDs 34 and dispersing that heat to the environment. In the illustrated embodiment, the base 136 is constructed as a single piece of aluminum. In other embodiments, multi-piece bases may be employed. As discussed above, the portion 152 of the mounting base 136 surrounding the module mounting portion 142 is raised in the illustrated embodiment. Preferably fins 154 are provided in the raised portion 152 of the mounting base 136. Such fins 154 help speed heat transfer from the mounting base to the environment. In the illustrated embodiment, fins are illustrated on the front side of the mounting base 136. It is to be understood that certain fin structures may also be formed in a back side of the mounting base.

In the illustrated embodiment the mounting base 136 preferably is powder coated with a bumpy-textured powder coat that creates many peaks and valleys whose feature heights are significant enough on average to enhance heat transfer relative to an unfinished metal base or flat-coated base. The back housing 138 illustrated in the embodiment shown in FIG. 6 need not be included in all embodiments. For example, in some embodiments the back portion of the light fixture will not be accessible or visible, and an installer may determine that back housing 138 is not desired With continued reference to FIG. 7, in the illustrated embodiment, a light modifying device 160, or lens, is adapted to rest on the front face 143 of the base 136 substantially in front of the LEDs 34. The illustrated lens 160 is specifically configured for the illustrated embodiment, which comprises three modules that each comprises three LEDs. As such, the lens 160 comprises nine lens portions 162, one portion corresponding to each LED. Most preferably, each lens portion is specially adapted to collimate light from the corresponding LED. Further, each lens portion preferably is adapted to provide a total internal reflection of LED light in order to maximize the usefulness of the light emitted from each LED. The lens 160 may be colored or clear, and preferably, comprises kinoform diffusers that are adapted to direct the collimated LED light in a desired shape and/or direction.

Above the lens portion 160 is a protective plate 164 or lens. The protective plate preferably is transparent or translucent, and communicates light from the LEDs 34 therethrough while simultaneously protecting components from access from outside the fixture.

A housing face, or cover 134, preferably is configured to lockingly engage to the base 136 and encloses the protective plate 164, lens portion 160, lighting modules 32 and a portion of the base 136. Preferably, the face 134 also comprises a heat conductive material, such as aluminum, that preferably is powder coated. Since the face likely is the most visible portion of the LED luminaire 130, it is anticipated that in certain embodiments a bumpy-surfaced powder coating will be visually undesirable. Nevertheless, even though a raw metal look is acceptable, it is most preferable that the face 134 at least have a smooth powder coat or layer of paint. In any case, it is anticipated that, in some embodiments, internal components such as the base 136 may be rough-texture powder coated, while external portions such as the face 134 may be uncoated or have a different type of surface coating/texture.

Preferably, the face 134 includes an internal spacer 170 that generally corresponds to the protective plate 164 and lens 160 so as to the control the position of the protective plate and the lens member relative to the position of the LEDs 34. The spacer 170 preferably depends inwardly from the front portion of the face/cover 134. The face is mounted on the base plate 136 so that the spacer 170 contacts the front 143 of the mounting base. Preferably, the spacer 170 and the fins 154 are sized so that at least a portion of the fins 154 are exposed, allowing heat within the area between the LED modules and the housing face plate to vent through the fins.

In the illustrated embodiment, a pair of threaded holes 172 are provided on either side of the cover 134. Additionally, a pair of opposing seats 174 are defined on the mounting base. Preferably, headless bolts, such as grub screws, are threaded into the cover holes 172 so as to engage the corresponding seat 174 formed in the mounting base 136. When both grub screws are in place, the cover is held securely onto the base plate, and the light modifying device 160 and protective lens 164 are enclosed between the cover and the base plate.

The fixture 130 preferably can be mounted in several different ways. For example, in the illustrated embodiment, the mounting base 136 preferably includes a pair of slide mount fixture apertures 180. Each slide mount aperture preferably has a first portion 182 with a relatively large diameter, which portion is configured to accept a mount bolt head. An elongate, second portion 184 of the slide mount aperture 180 has a smaller width, and is sized to accommodate a shaft portion of the mount bolt without allowing the bolt head to fit therethrough. Thus, in a conventional manner, a mount bolt head is advanced through the first portion 182 and then the mounting base 136 is rotated so that the mount bolt shaft seats in the second portion 184, thus holding the mount base in place on the mount bolt.

Preferably, other apertures 186 are also formed through the mounting base 136 in order to accommodate bolts and/or screws advanced directly through the mounting base. Still further, at least some of such apertures 186 include a plurality of threaded holes adapted to accommodate threaded bolts in order to mount the base 136 in place. In the illustrated embodiment, each of these mounting options are included in the mounting base, thus providing several options for mounting. It is to be understood that still further mounting options can be employed as well. For example, the illustrated embodiment includes another pair of threaded holes 188 along the edges of the mounting base. If desired, a gimbal mechanism can be attached to the mounting base at the threaded edge mount holes 188, and the gimbal mechanism can be used to mount the fixture.

With continued reference to FIG. 7, the driver 140 preferably is configured to receive line voltage input through the wires, and output an appropriate DC voltage through the mounting bosses. In the illustrated embodiment, the driver is configured to receive 120 VAC and transform it to about 30 VDC output of about 25 watts and 450 mA.

Figure 8:
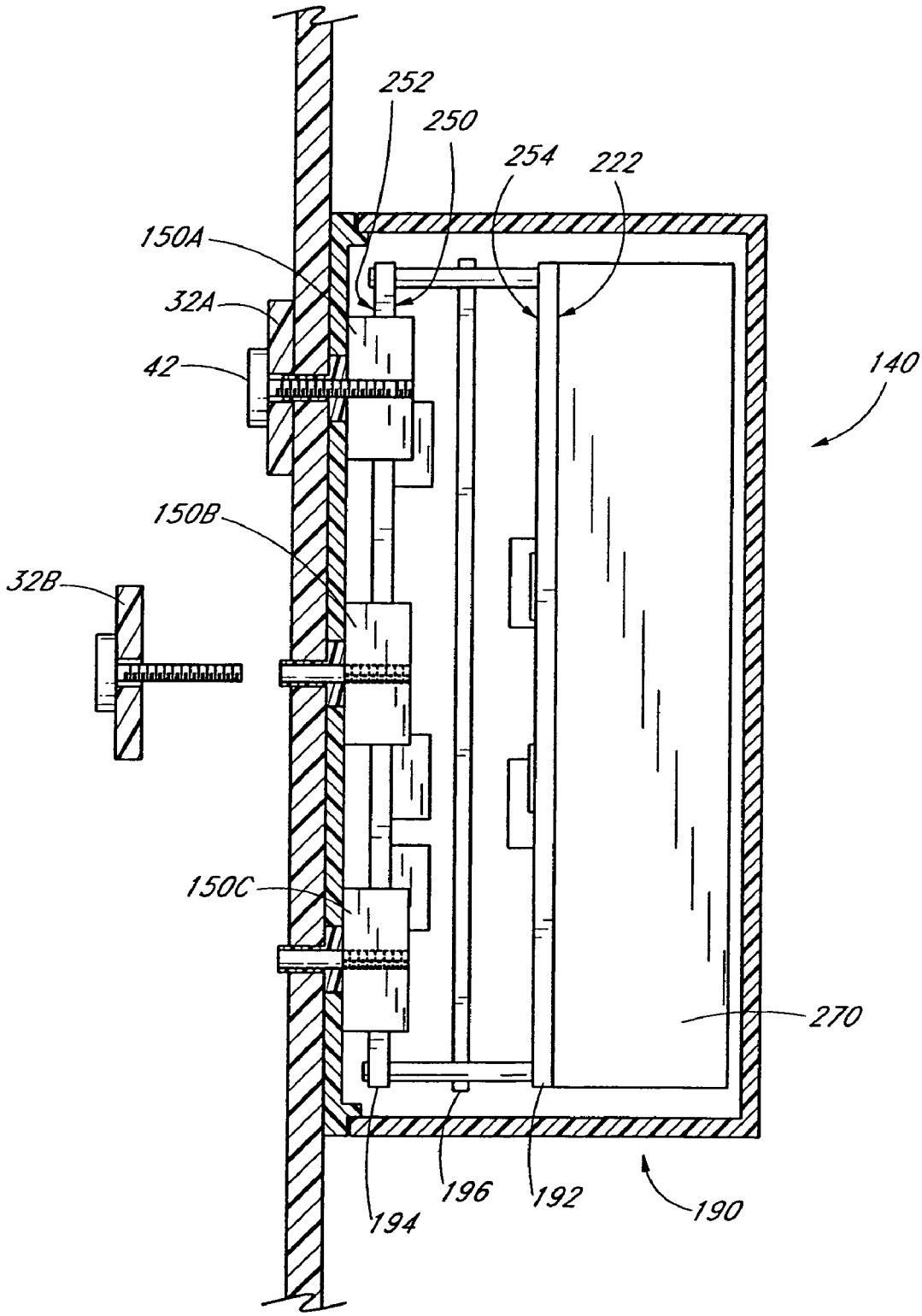
FIG. 8 is a schematic cross-sectional cutaway view of an embodiment of a power driver suitable for use in connection with the embodiment shown in FIG. 6.
Figure 9A:
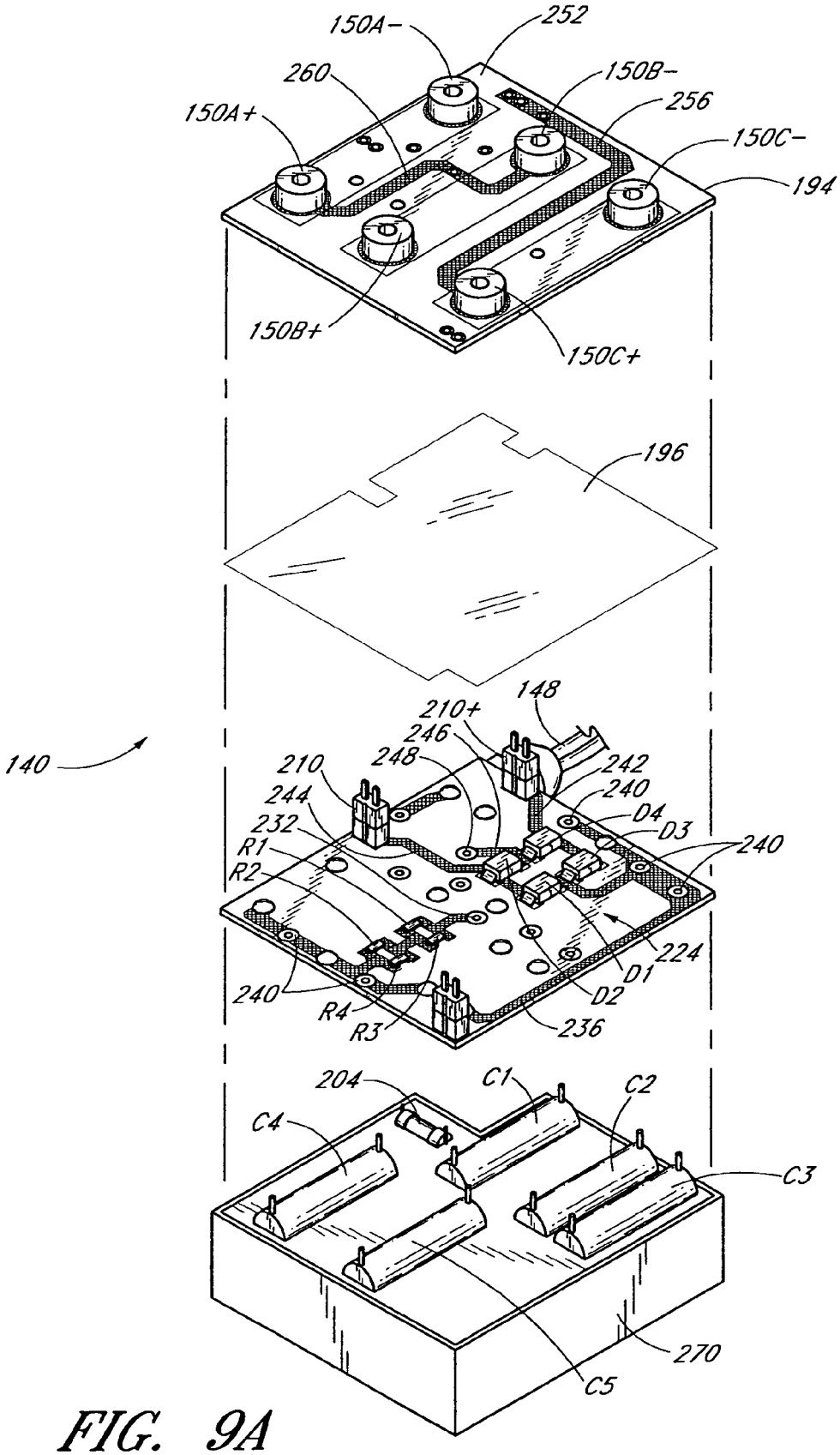
FIG. 9*a* is an exploded view of components of an embodiment of a power driver suitable for use in connection with the embodiment illustrated in FIG. 6.
Figure 9B:
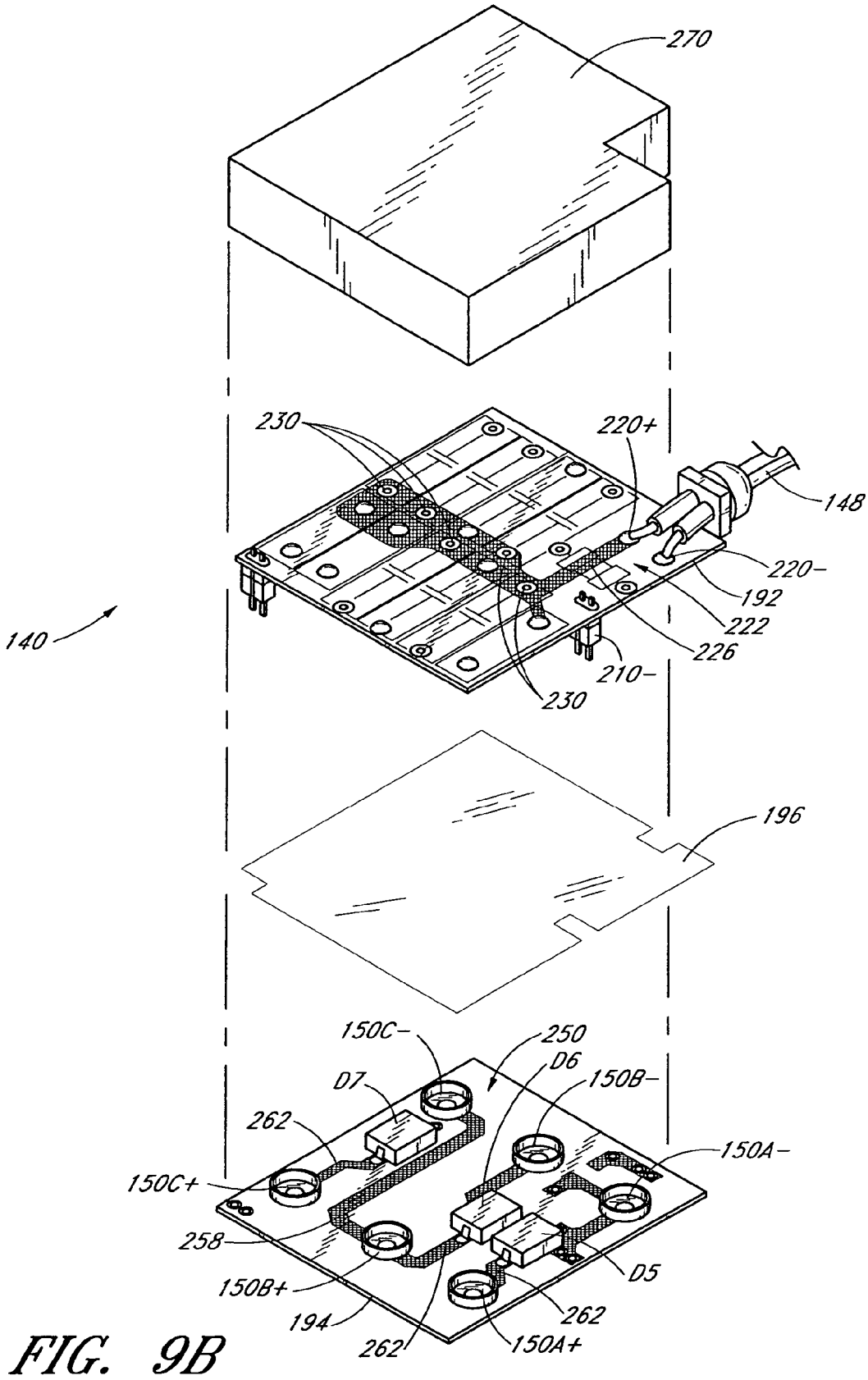
FIG. 9*b* is another exploded view taken from an opposite perspective from the exploded view of FIG. 9*a*.

With reference next to FIG. 8, a schematic cross-sectional view of the power driver 140 is illustrated. The driver comprises a housing 190 that encloses electrical componentry. A pair of spaced apart electrically connected circuit boards 192, 194 is enclosed within the housing. A dielectric sheet 196 is disclosed between the circuit boards 192, 194, and resists electrical interaction between the boards 192, 194. A mount circuit board 194 comprises the mounting bosses 150. The mount board 194 is electrically connected to a power conditioning board 192, which comprises certain electrical components configured to step-down and condition an input voltage. With reference next to FIGS. 9*a* and 9*b*, an exploded view of a preferred embodiment of a driver 140 illustrates the circuit boards 192, 194, dielectric 196, and certain electrical components.

Figure 10:
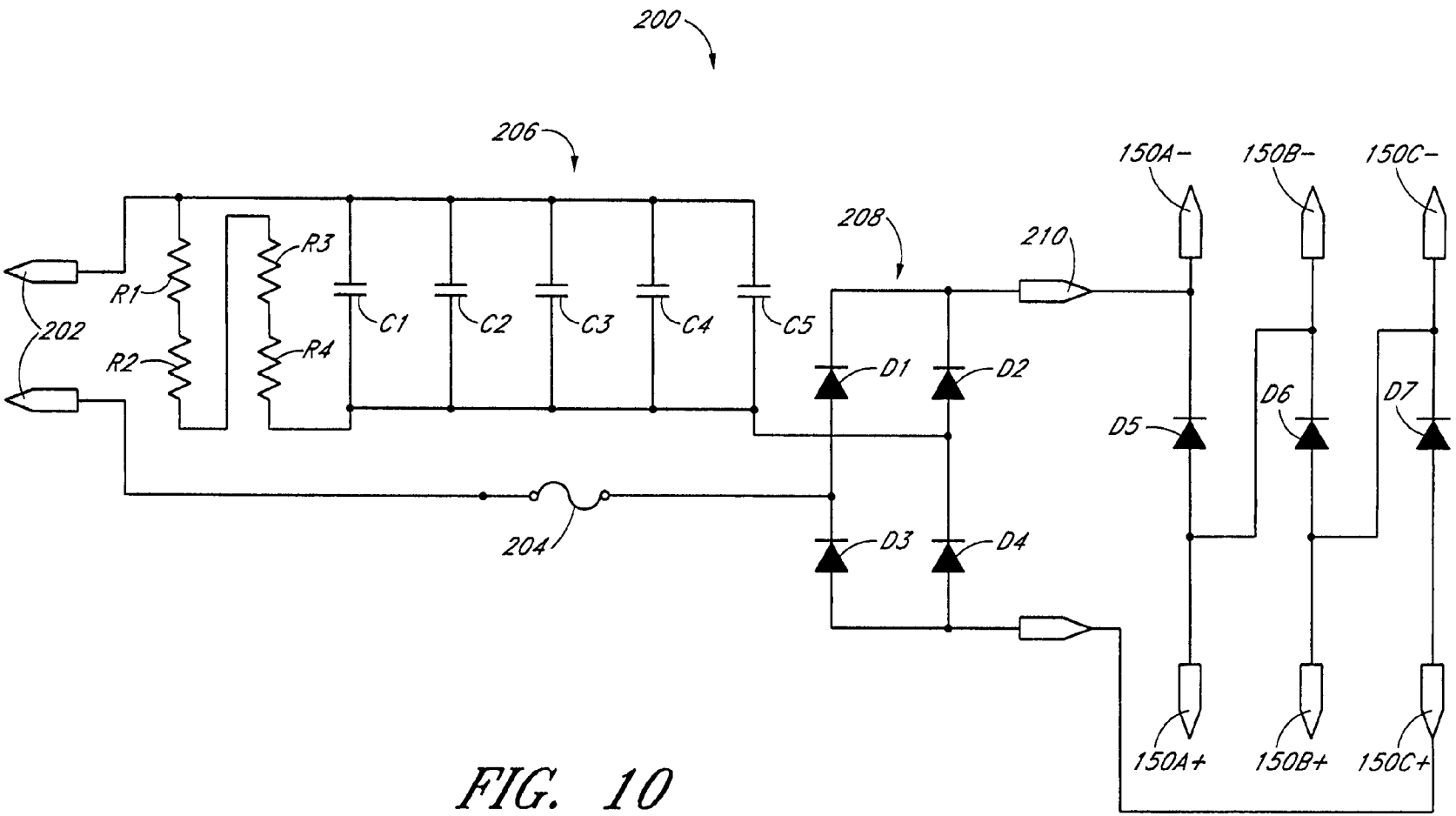
FIG. 10 is a schematic electrical circuit diagram representing a circuit configuration of an embodiment of a power driver as in FIGS. 8 and 9.

With reference next to FIG. 10, a circuit diagram 200 representing electrical componentry of a preferred embodiment of a driver is depicted. As depicted in the diagram, input electrical power, such as from line voltage, is supplied at input nodes 202. A fuse 204 is provided for safety purposes. The circuit includes a portion 206 for stepping the input voltage down to a desired voltage. In the illustrated embodiment, the step-down portion 206 comprises a plurality of resistors R1, R2, R3, R4 arranged in parallel with a plurality of capacitors C1, C2, C3, C4, C5. As with the construction that uses two stacked circuit boards, preferably a plurality of capacitors are used rather than a single large capacitor in order to save on both cost and bulk of the device. Further, the illustrated step-down portion 206 enables the driver to step down the voltage without requiring a bulky, heat-producing transformer.

With continued reference to FIGS. 9 and 10, the circuit 200 includes a rectifying arrangement 208 comprising diodes D1, D2, D3, D4 arranged in a manner to rectify the supplied AC current into a DC current. Preferably, the step-down and rectifying portions 206, 208 of the circuit 200 are arranged on the power conditioning board 192. Connectors 210 are supplied for electrically connecting the power conditioning board 192 to the mount board 194. The power conditioning board preferably comprises the three pairs of mount bosses 150A-C. In the illustrated embodiment the pairs of bosses are arranged in electrical series relative to one another. Preferably, diodes D5, D6, D7 are provided to allow some back current to flow, but prevent forward current from flowing between the bosses. Instead, current is forced to flow through a lighting module attached to the bosses.

The illustrated circuit 200 not only steps down and rectifies voltage, but provides that voltage evenly across the pairs of mounting bosses 150A-C. When three LED modules 32A-C are attached to the bosses 150A-C as illustrated above in FIGS. 6 and 7, a circuit is completed from the driver 140 through the first lighting module 32A, back into the driver, to the second lighting module 32B, back into the driver, and lastly to the third lighting module 32C and back to the driver 140. As such, standardized lighting modules 32 can be individually replaced, as substantially all power delivery circuitry is enclosed within the driver 140. Of course, it is to be understood that a driver having only a pair of mount bosses can be provided in connection with a lighting module having several LEDs arranged in any desired geometric and electrical arrangement, but designed to correlate with the driver's power supply characteristics.

In the illustrated embodiment three identical lighting modules 32A-C are employed. It is to be understood that, in other embodiments, various geometrical configurations can be employed. As such, three or more, or less, lighting modules 32 can be employed in other embodiments, and the lighting modules need not necessarily be the same size and/or shape and may not necessarily employ the same number or color of LEDs. For example, in certain lighting fixtures having other geometric configurations, it may make sense to have smaller lighting modules and larger lighting modules that are powered by the same driver. Preferably, the lighting modules can be connected to a driver without requiring additional wiring between the modules. Principles and aspects discussed in the above embodiments disclose a simple manner of connecting individual modules in place wherein the connection provides both the electric supply and physical connection. Further, one or more modules of a multimodule luminaire may be removed and replaced independent of the other modules. It is to be understood that, in other embodiments, additional physical connectors that are not electrically conductive may also be employed with certain lighting modules. Also, principles and aspects discussed herein may be employed in embodiments in which physical connection and electrical connection are not simultaneously supplied through fasteners.

The illustrated circuit diagram anticipates a 120 VAC input. However, it is to be understood that the principles disclosed herein can be employed in connection with other input voltage, such as 240 vac or high- and low-voltage AC inputs. Of course, changes and enhancements can be made, and additional features can be added to the circuit diagram 200 disclosed in FIG. 10 without detracting from the teachings or operability thereof.

Figure 11A:
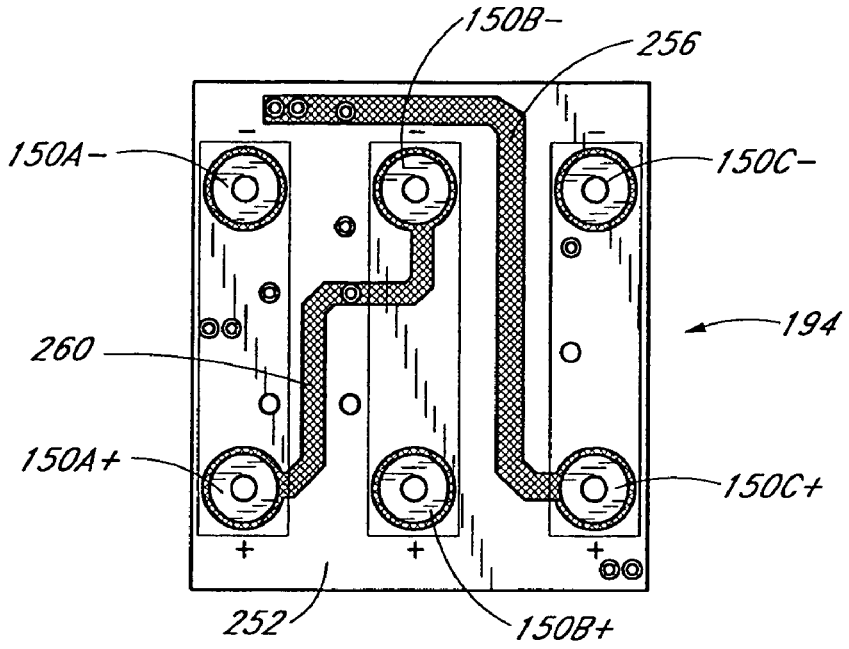
FIG. 11*a* is a schematic view of a first side of a mount board of the power driver of FIG. 8.
Figure 11B:
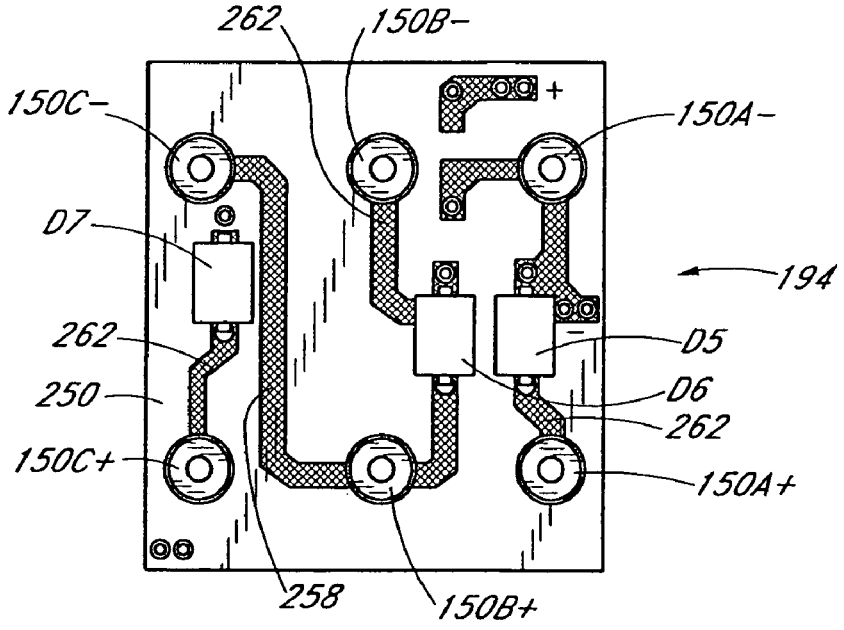
FIG. 11*b* is a schematic view of a second side of the mount board of FIG. 11*a*.
Figure 12A:
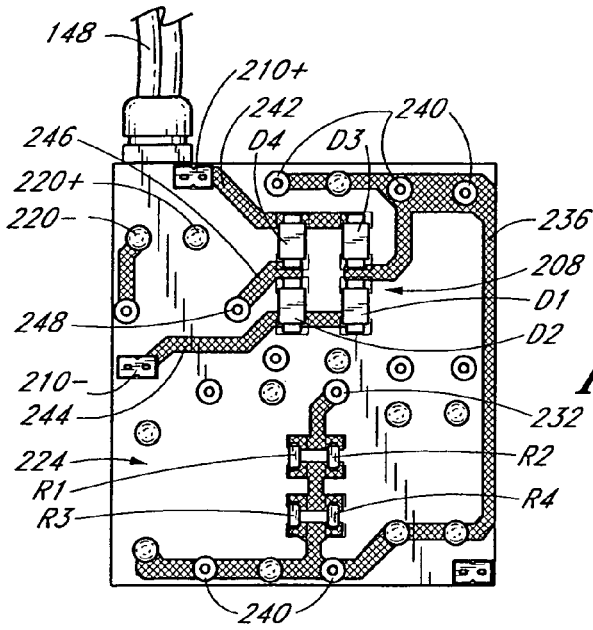
FIG. 12*a* is a schematic view of a first side of a power conditioning board of the power driver of FIG. 8.
Figure 12B:
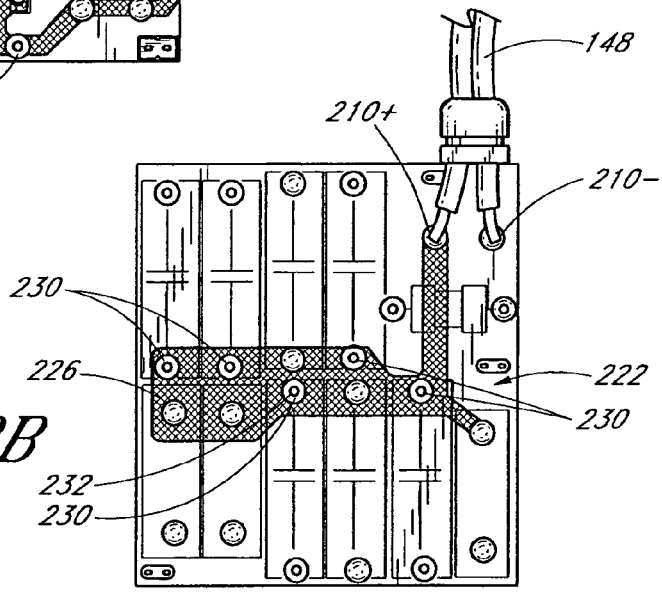
FIG. 12*b* is a schematic view of a second side of the power conditioning board of FIG. 12*a*.
Figure 13:
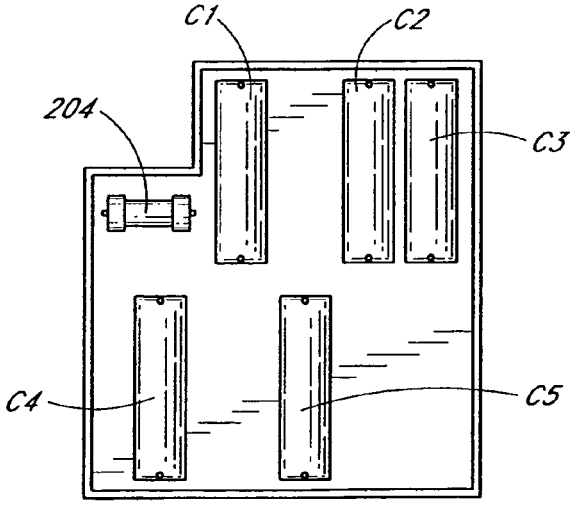
FIG. 13 illustrates certain electrical components partially encased within a hardened resin, which components are adapted to engage the power conditioning board of FIGS. 12*a* and 12*b*.

With continued reference to FIGS. 8-10, and with additional references to FIGS. 11 and 12, detailed views of one embodiment of a power driver 140 for the illustrated multi-module LED-based luminaire 130 are presented. As illustrated, preferably the input wires 148 connect to the power conditioning board 192 at input connector holes 220. The power conditioning board 192 has a first side 222 and a second side 224, and circuit traces are formed on both sides. From the input connector holes 220, a first side trace 226 delivers power to the capacitors C1-C5 at respective capacitor positive mount holes 230. The capacitor mount holes 230 for capacitor C5 transmits electricity through the board 192 to the second side of the board 224, and a second side trace 236 leads to the resistors R1-R4 and to the negative side capacitor mount holes 240. The trace 236 then leads power to the rectifying arrangement 208 of diodes D1-D4 from which a positive component of power is directed along a trace 242 to a positive connector/spacer 210+ and a negative component of power is directed along a trace 244 to a negative connector/spacer 210−. A negative power input trace 246 connects to a fuse mount hole 248 which directs electrical power through the fuse 204 and to the negative input connector hole 220−.

In the illustrated embodiment, three spacer members 210 connect the power conditioning board 192 to the mount board 194. However, only a positive spacer/connector 210+ and a negative spacer/connector 210− conduct electricity to the mount board 194. Preferably, the positive spacer/connector 210+ attaches to the mount board 194 so that positive electrical energy is applied to a positive trace 256 on the second side 252 of the mount board 194. Electrical energy is thus delivered to a positive node 150C+ of a first pair of mount bosses 150C. When lighting modules 32 are mounted as anticipated, electric power will pass through the first lighting module 32C to the negative pole 150C− of the first pair of mounting bosses 150C. A trace 258 on the first side 250 of the mount board 194 delivers electrical power to the positive pole 150B+ of a second pair of bosses 150B. From the negative pole 150B− of the second pair of bosses 150B, a trace 260 on the second side 252 of the board 194 delivers power to a positive pole 150A+ of the third pair of bosses 150A. From the negative pole 150A− of the third pair of bosses 150A, electrical energy is delivered to the negative spacer/connector 210−. The first side 250 of the mount board 194 comprises diodes D5, D6, D7 arranged in circuit traces 262 between each pole of the paired mount bosses 150. However, such diodes are arranged to prevent electrical flow from the plus to minus direction, and thus do not interfere with delivery of power to the lighting modules 32.

Preferably, electric components that are connected to the first side 222 of the power conditioning board 192 are at least partially enveloped in a hardened resin 270 in order to hold such components securely in place, and improve the durability of the driver. Preferably, such a hardened resin 270 is first poured into the driver housing 190. Before the resin cures, the assembled circuit boards 192, 194 are placed in the housing 190. Most preferably, the hardened resin 270 has minimal, if any, interaction with the power conditioning board 192 itself. Notably, a plurality of capacitor spaces on the power conditioning board 192 are unused, as are other component spaces. Thus, the illustrated board may be used in other embodiments employing more, less, or different capacitors and other components while maintaining its interchangeable size. As such, the driver 140 can be further specialized for different embodiments while maintaining its size and general configuration.

In the embodiments illustrated above, threaded fasteners have been employed to connect the lighting modules to the mount bosses and supply electricity to the modules. It is to be understood, however, that other embodiments may use other types of fasteners to both hold the modules in place and to communicate electric power from the driver to the modules. For example, with reference next to FIGS. 14*a* and *b*, in another embodiment, posts 280 engage the mounting bosses 282 of an embodiment of a driver 284. As such, the posts 280 are energized and extend outwardly from the driver 284. Preferably, each post 280 has a clip 286 attached to a distal end thereof. In the illustrated embodiment, each post 280 extends through a mount aperture 288 formed in the mount member 290.

In the illustrated embodiment, a lighting module 292 employing LEDs 34 having an input trace 294, an output trace 296, and one or more LEDs arranged thereon is provided. However, the LED lighting module 292 has no mount apertures. Instead, in the illustrated embodiment, the lighting module 292 is slipped under the clips 286 and held securely in place by the clips 286, which preferably are spring loaded. The opposing clips engage opposing poles of the positive and negative input traces.

Figure 14B:
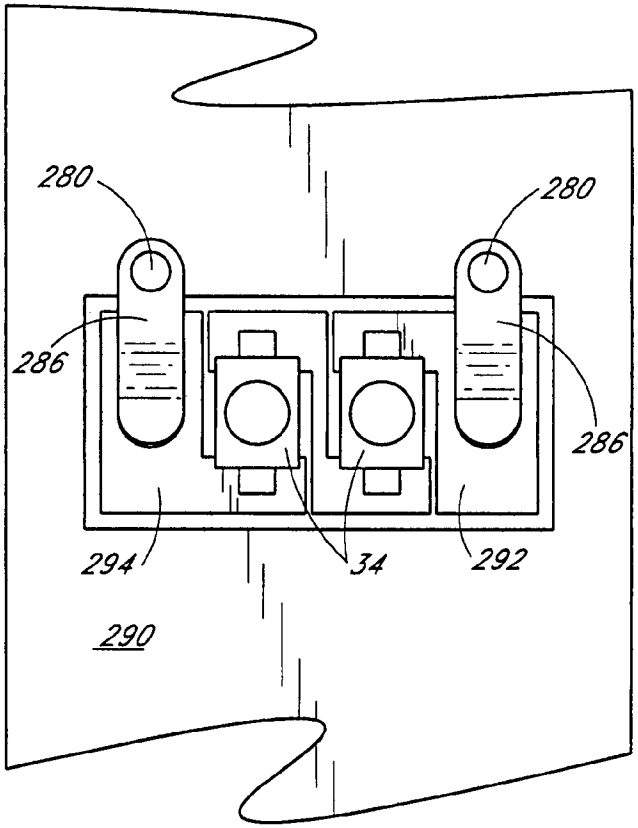
FIG. 14*b* is a partial front view of the embodiment illustrated in FIG. 14*a*.
Figure 14A:
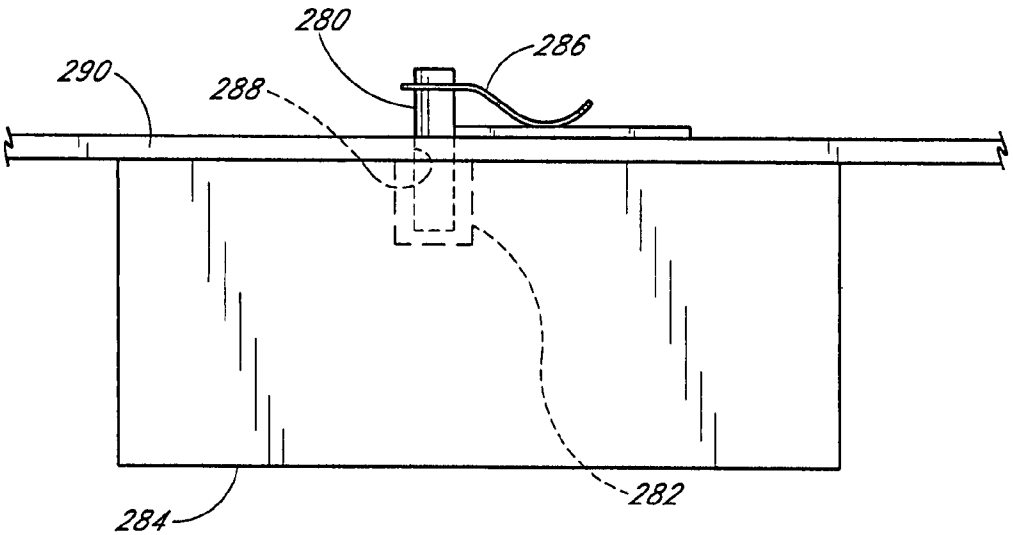
FIG. 14*a* is a partially cutaway side view of another embodiment of an LED-based luminaire.

It is to be understood that any desired method or means for attaching the post clip to the mount boss can be employed. For example, the post 280 may threadingly engage the mount boss 282; the post 280 may be integrally formed with or have an interference fit with the mount boss, and the clip portion 286 may be detachably connected to the post; the post may connect to the mount boss in a "bayonet"-type connection, or the like. FIGS. 14*a* and *b* illustrate just one variation for connecting a module 292 to a mount member 290 and to a driver 284 on the opposing side of the mount member. Other variations for connecting a lighting module to a mount member and driver may also be employed. For example, in an additional embodiment, a lighting module has one aperture that is larger than the other mount aperture, as does the mount member. Each pole of the mounting bosses in the driver has a diameter corresponding to the appropriate module aperture. As such, it will be difficult or impossible to connect the input traces to the incorrect pole of the driver, because different sizes of fasteners will be employed for each pole. Other mounting mechanisms may employ spring loaded members, other clip configurations, or the like.

Figure 15:
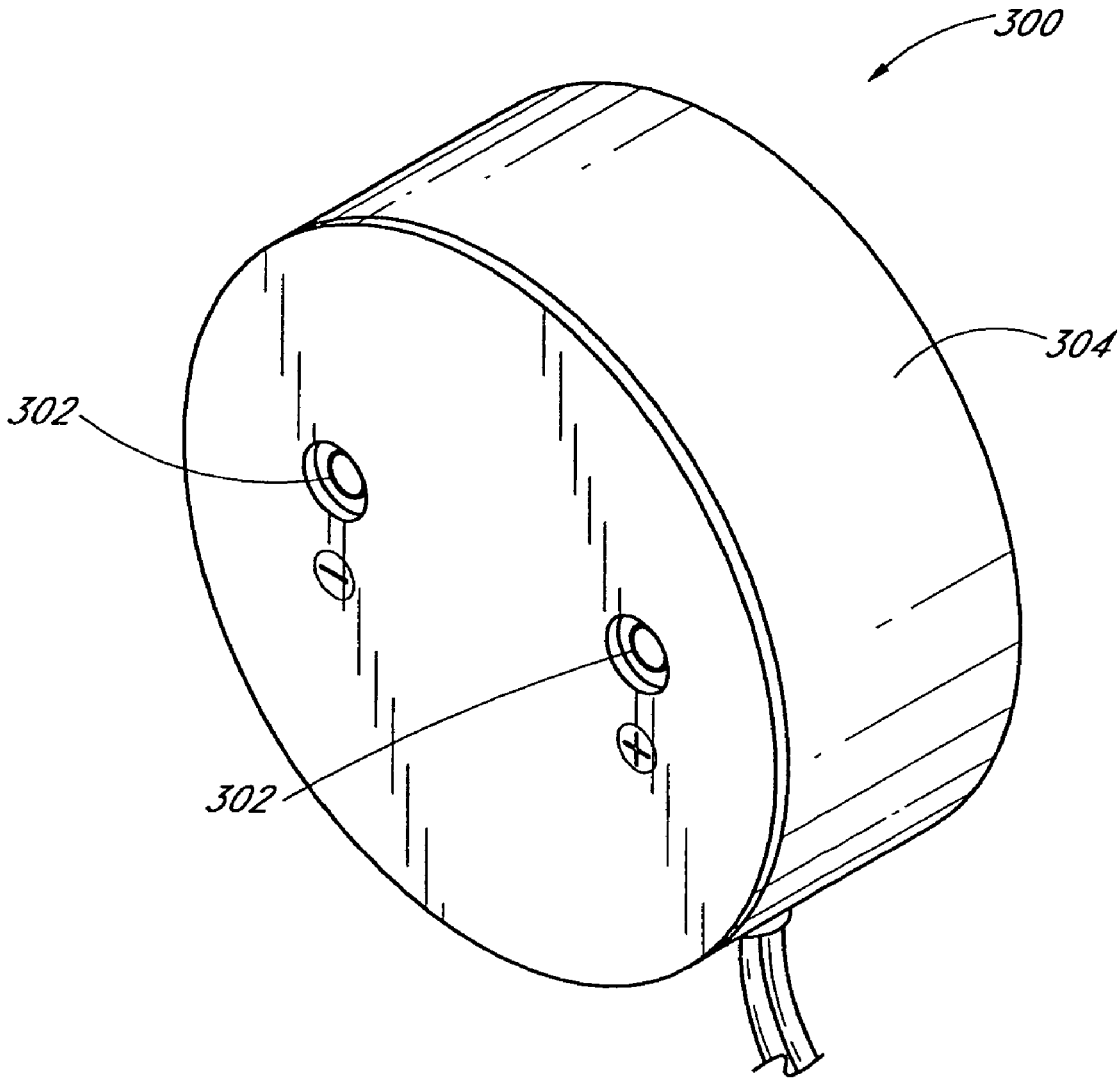
FIG. 15 is a perspective view of another embodiment of a power driver that may be used in connection with certain embodiments of LED-based luminaires.
Figure 16:
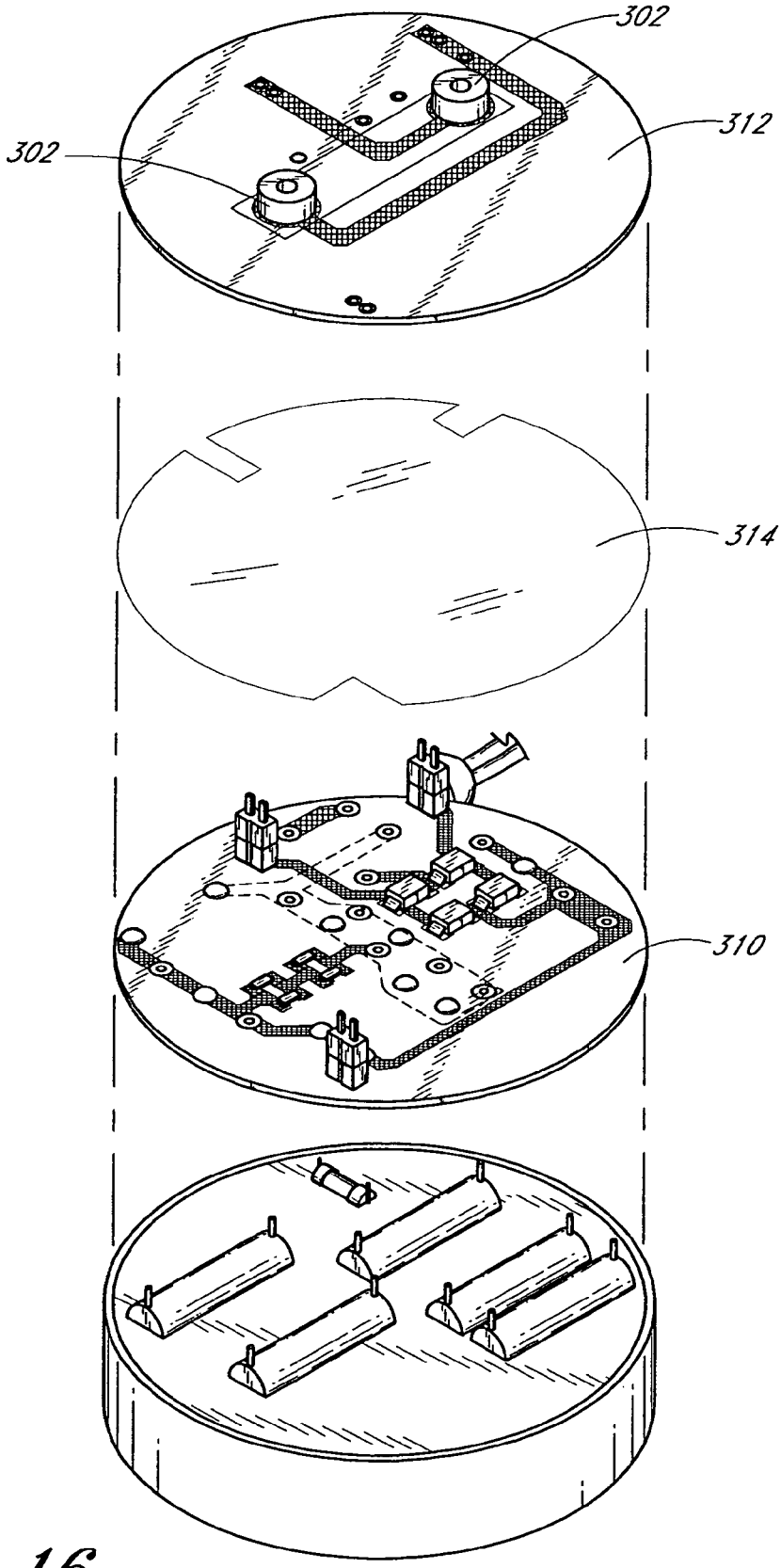
FIG. 16 is an exploded view showing internal componentry of the power driver of FIG. 15.

With reference next to FIGS. 15 and 16, in another embodiment, a driver 300 is provided having a generally cylindrical housing shape. Preferably, the driver 300 is still configured to receive electrical input, condition the electrical input as desired, and provide output at mounting bosses 302 arranged within the driver 300 but which are accessible through a driver housing 304. Additionally, an embodiment of a driver 300 may employ a power conditioning board 310, a mount board 312, a separator 314 and the like in a manner quite similar to that discussed above. However, preferably such circuit boards and components are configured to fit within the generally cylindrical housing 304.

Figure 17A:
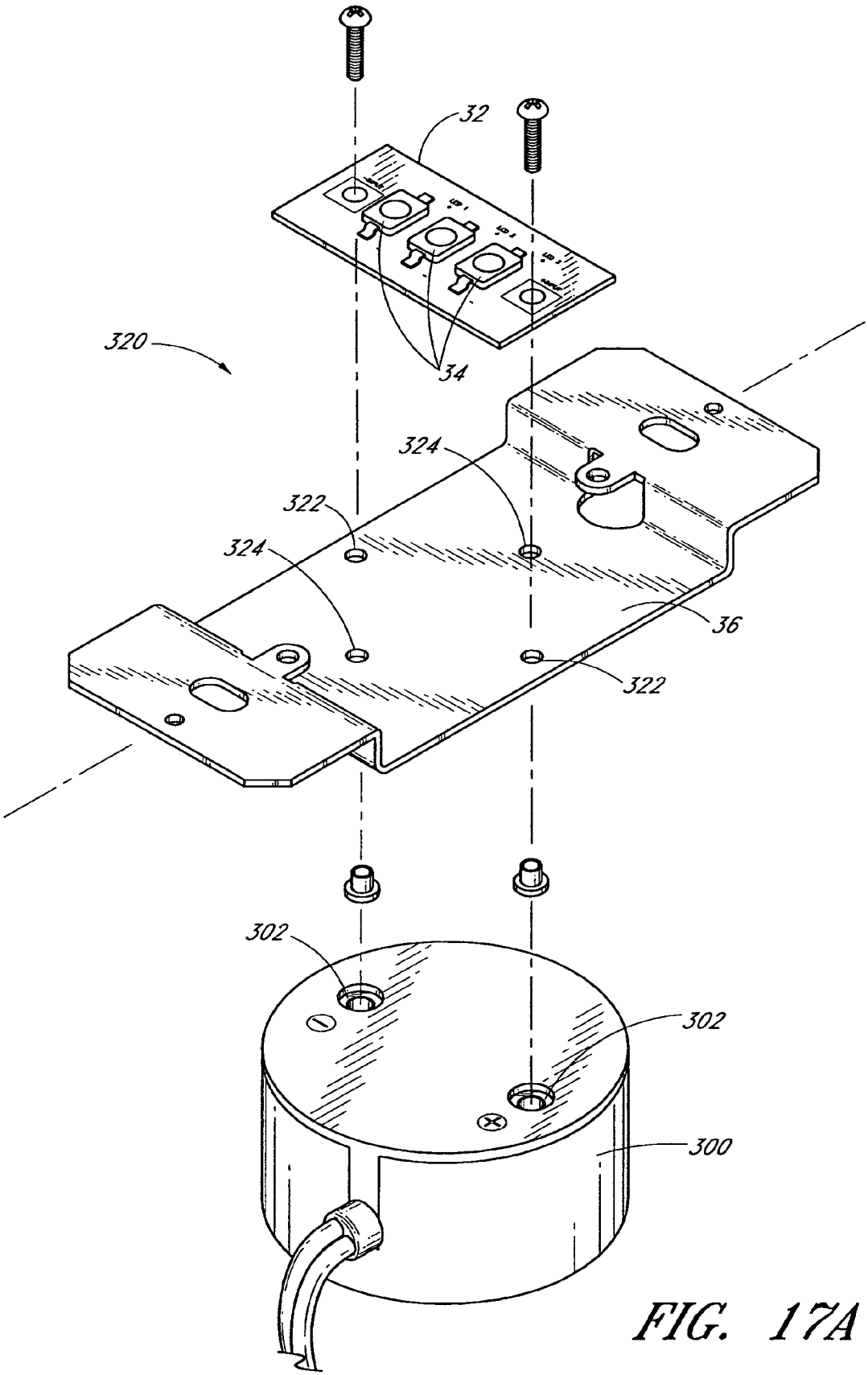
FIG. 17*a* is an exploded view of another embodiment of a LED-based luminaire arranged in a first configuration.
Figure 17B:
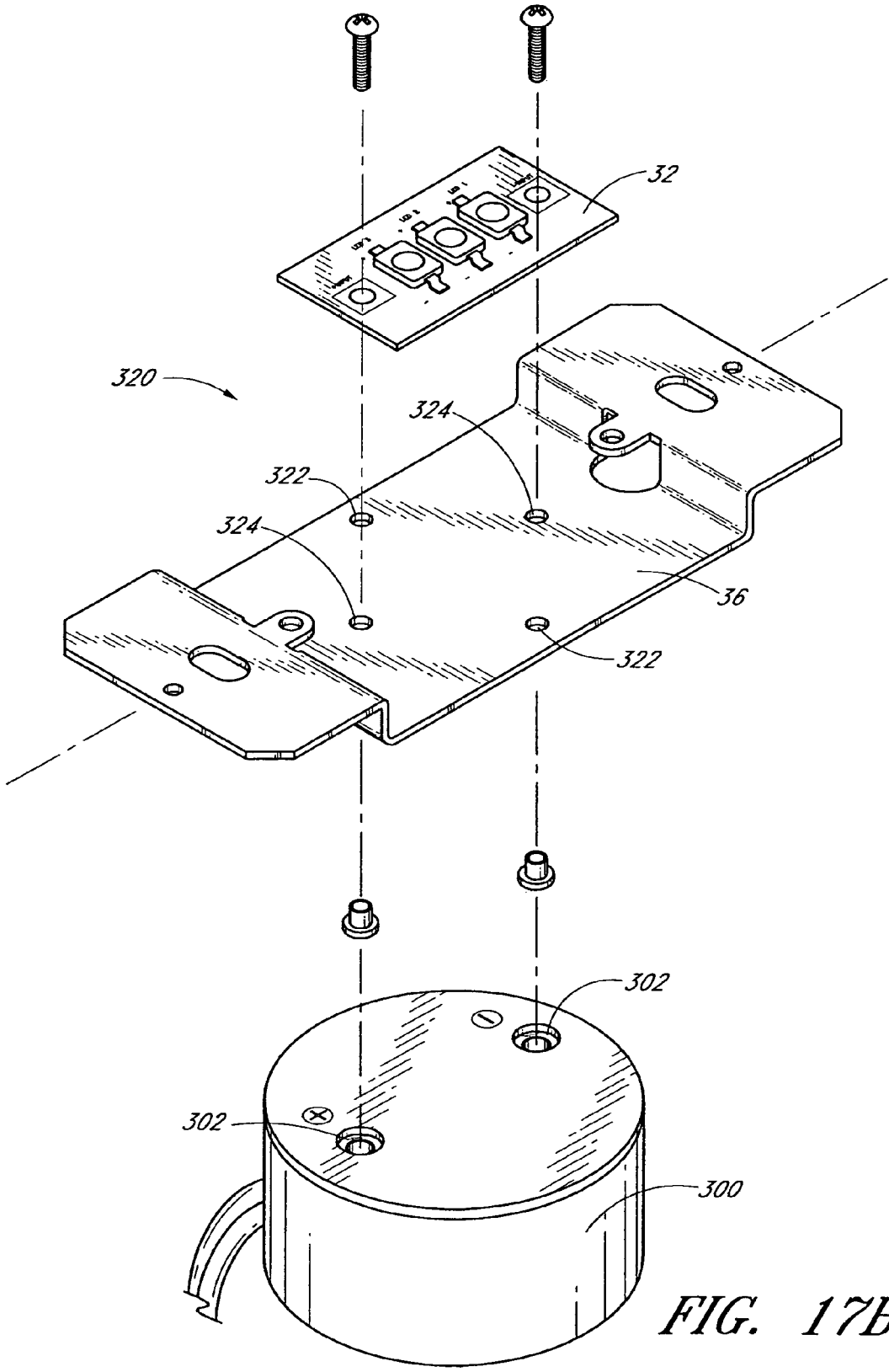
FIG. 17*b* is an exploded view of the LED-based luminaire of FIG. 17*a* arranged in a second configuration.

With reference next to FIGS. 17*a* and 17*b*, a modular lighting system 320 employing such a cylindrical driver 300 may have significantly increased versatility over more traditional systems. For example, as illustrated in FIG. 17*a*, a mount member 36 is provided having two pairs of mounting apertures 322, 324. In FIG. 17*a*, the first pair of mounting apertures 322 is employed, thus resulting in a device 30 having substantially the same configuration as the device illustrated in connection with FIGS. 1 and 2. In FIGS. 17*b*, however, the second mounting apertures 324 are employed. Thus, the lighting module 32 is arranged along a longitudinal axis 326 of the mount member 36 as opposed to the configuration of FIG. 17*a* in which the lighting module 32 is arranged generally transverse to the longitudinal axis 326 of the mount member 36.

In the FIG. 17*b* configuration, the power driver 300 is rotated in order to align with the LED module 32 and second mount apertures 324. However, such rotation of the driver 300 creates substantially no change in the footprint shape of the driver 300 on the mount member 36 or within an associated light fixture, even though the arrangement of the lighting module 32 and thus the spacing of the LEDs and shape of the emitted light is different than in the embodiment of FIG. 17*a*. This type of system allows more versatility in creating light fixtures having light of various patterns or the like without requiring specialized parts, especially drivers, for each configuration. Accordingly, a modular light fixture creation system is envisioned in which a minimum of basic parts, namely drivers, modules, mount members and the like can have marked versatility and selectively be assembled in various configurations. For example, the embodiment of FIGS. 17*a* and *b* can be assembled into significantly different configurations without changing the footprint of the overall LED-based luminaire.

Figure 18:
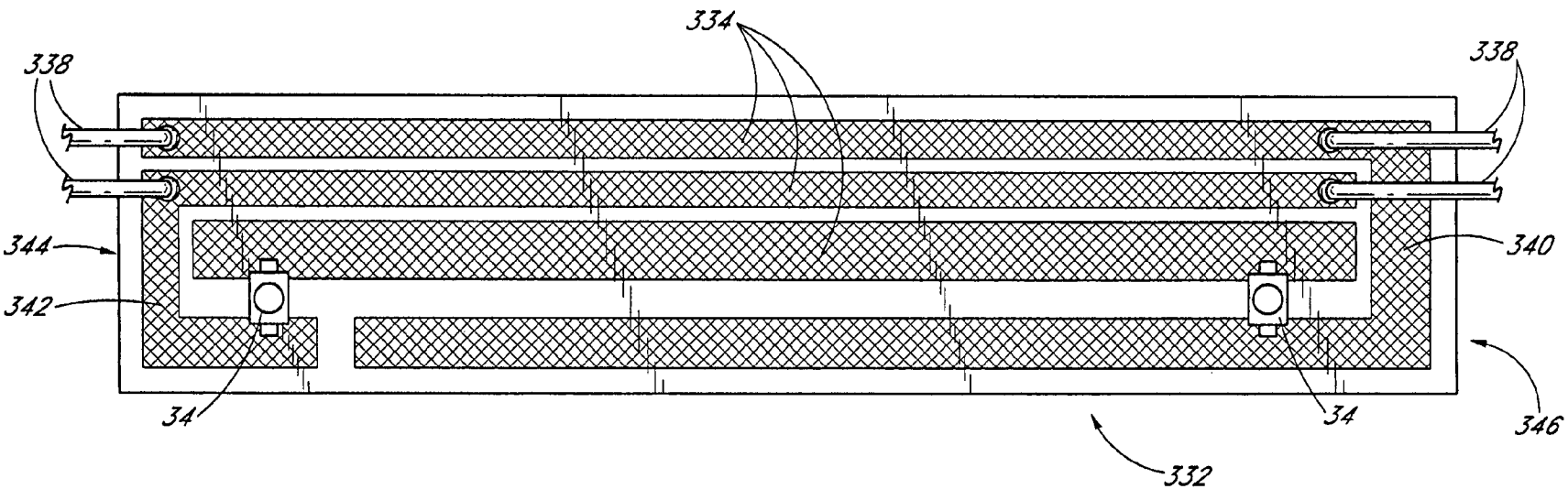
FIG. 18 is a plan view of another embodiment of an LED module suitable for use in yet another embodiment.

With reference next to FIG. 18, another embodiment of an LED-based lighting module 332 is provided. In the illustrated embodiment, a pair of LEDs 34 are disposed on circuit traces 334 so as to be in an electrically series arrangement. Flexible conductors 338 are attached to a positive 340 and negative 342 trace, respectively adjacent a first end 344 of the module 332. Positive and negative conductors are also attached to positive and negative traces 340, 342, respectively, adjacent a second end 346 of the module 332. As such, a plurality of such modules 332 can be connected end-to-end in a daisy chain type of arrangement so that the modules are in an electrically parallel arrangement relative to one another. Preferably, the modules 332 are fairly elongate, and can be up to several inches in length if desired.

Figure 19:
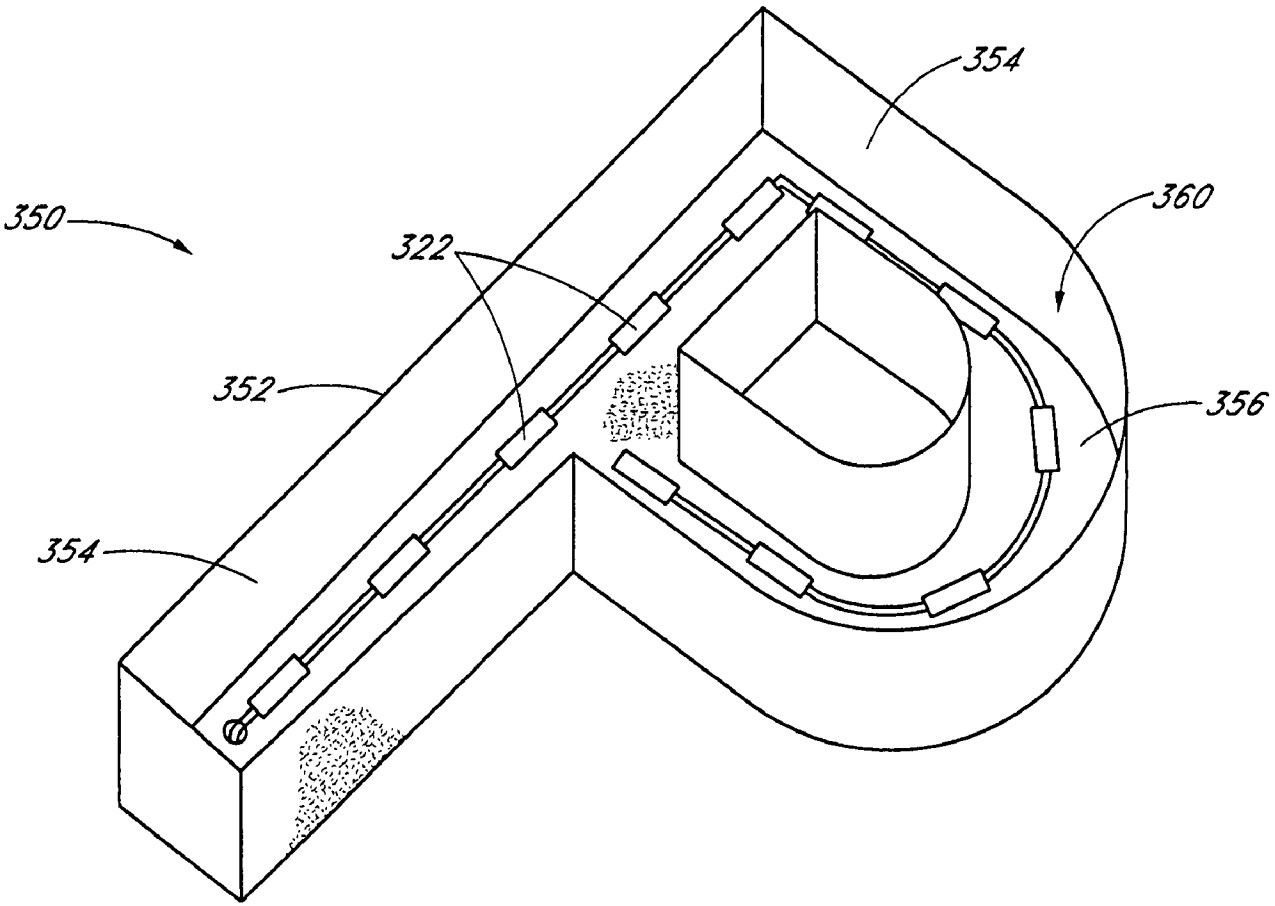
FIG. 19 illustrates an embodiment of a channel illumination apparatus employing a plurality of the LED modules of FIG. 18.

With reference next to FIG. 19, an embodiment of a channel illumination apparatus 350 is disclosed comprising a casing 352 in the shape of a "P." The casing 352 includes a plurality of walls 354 and a back 356, which together define at least one channel 360. In the illustrated embodiment, a chain of several modules 332 is linked together and attached to a surface of the casing 352. Preferably the modules 332 are adhered to the surface with a heat conductive tape. Preferably, the surfaces of the walls 354 and bottom 356 are coated with a light reflective coating. The walls 354 are preferably formed of a durable sturdy metal having relatively high heat conductivity. A translucent light diffusing lens (not shown) is preferably disposed on a top edge of the walls, and encloses the channel 360. With the daisy chain of modules 332 arranged in the channel 360, the modules can be lit, and thus creating a lighted channel sign 350.

In the illustrated embodiment, preferably the walls 354 and back 356 of the channel casing 352 are coated with a powder coat that is visibly bumpy-textured. Preferably, the powder coat is a semigloss or glossy white color. Most preferably, however, it is simply a light-reflective color. Preferably, the powder coat is sufficiently bumpy so as to have a feature height that enhances heat transfer to the environment. As such, even though the casing walls 354 and back 356 preferably have a high heat conductivity, and can function as a heat sink, preferably the light energy emitted by the lighting modules 332 is directed away from the heat sink material. Further, the bumpy powder coat enhances heat transfer from the heat sink material to the environment. Most preferably, an outer surface of the heat sink material is also powder coated, preferably with a bumpy-textured powder coat. Even if such outside surface is not appropriately colored white, or even a light reflective color, heat transfer from the heat sink can be enhanced.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A lighting apparatus, comprising:

a lighting module having:

at least one light emitting diode (LED);

a dielectric member; and a plurality of electrically conductive contacts disposed on the dielectric member, the contacts configured to mount the at least one LED to supply electrical current to the LED;

a mount member comprising a module receiving portion that engages the lighting module;

a power driver arranged on a side of the mount member generally opposite the lighting module, the driver adapted to receive power and condition the power to a desired state, the driver comprising first and second polarized connectors and a housing, the connectors being fully enclosed within the driver housing; and first and second fasteners configured to electrically and physically engage the lighting module and the first and second polarized connectors, respectively, of the driver so as to secure the lighting module and driver onto the mount member with the mount member sandwiched between the lighting module and the driver, the fastener being electrically spaced from the mount member;

wherein the fastener is electrically conductive, and conducts electric power from the driver to a contact of the LED module.

2. The lighting apparatus of claim 1, wherein the driver comprises connectors that electrically and physically engage a pair of fasteners, the connectors being polarized, and the connectors are substantially enclosed within a driver housing.

3. The lighting apparatus of claim 2, wherein the mount member has a pair of mounting apertures adapted to accommodate insulators and the fasteners so that the fasteners are electrically insulated from the mount member, and the fasteners physically and electrically engage positive and negative input contacts, respectively, of the lighting module.

4. The lighting apparatus of claim 3, wherein the mount member has a second pair of mounting apertures that accommodate the fasteners and lighting module in a second position on the mount member, and a footprint of the driver relative to the mount member is substantially the same whether the lighting module is attached in the first position or the second position.

5. The lighting apparatus of claim 4, wherein the driver has a substantially cylindrical housing.

6. The lighting apparatus of claim 2, wherein the driver comprises a plurality of pairs of bosses to electrically and physically secure the fasteners, and the driver and bosses are configured so that pairs of bosses are electrically in series relative to one another.

7. The lighting apparatus of claim 6, wherein a first lighting module has a first geometric shape, a second lighting module has a second geometric shape that is different from the first geometric shape, and the mount member and power supply are configured to accommodate the first and second lighting modules.

8. The lighting apparatus of claim 1, wherein the mount member and driver are configured to accommodate a plurality of lighting modules, and the driver supplies electric power to each lighting module through a fastener that connects the driver to the respective module.

9. The lighting apparatus of claim 1, wherein the mount member comprises a metal, and the metal mount member functions as a heat sink.

10. The lighting apparatus of claim 9, wherein the mount member comprises a coating having a visibly bumpy surface texture so that the coated mount member surface has a greater average feature height than a surface that appears relatively flat.

11. The lighting apparatus of claim 10, wherein the mount member coating is substantially white.

12. The lighting apparatus of claim 11, wherein the mount member is powder coated.

13. The lighting apparatus of claim 12, wherein the powder coat increases the surface area of the mount member relative to a surface of the uncoated metal.

14. A lighting apparatus, comprising:

a lighting module having:

at least one light emitting diode (LED);

a dielectric member; and a plurality of electrically conductive contacts disposed on the dielectric member, the contacts configured to mount the at least one LED to supply electrical current to the LED;

a mount member having a module receiving portion that engages the lighting module;

a power driver arranged on a side of the mount member generally opposite the lighting module, the driver adapted to receive power and condition the power to a desired state; and a pair of fasteners configured to engage the lighting module and the driver so as to secure the lighting module and driver onto the mount member with the mount member sandwiched between the lighting module and the driver, the fasteners being electrically spaced from the mount member;

wherein the fasteners are electrically conductive, and conduct electric power from the driver to a contact of the LED module;

wherein the driver comprises connectors that electrically and physically engage the pair of fasteners, the connectors being polarized, and the connectors are fully enclosed within a driver housing; and wherein the fasteners and connectors are threaded so as to engage one another.

15. A luminaire adapted to be customized to a plurality of configurations, comprising:

a lighting module comprising a body, a plurality of electrically-conductive circuit traces, a positive and negative input trace each being configured to accept a positive and negative electrical input, respectively, and at least one light emitting diode (LED) attached to the traces so that electric power from the positive and negative input traces will flow through the LED;

a mount member comprising a lighting module mounting portion and a fixture mount portion, the mount member having a first pair of spaced apart mounting apertures and a second pair of spaced apart mounting apertures, each pair of mounting apertures being spaced a distance generally corresponding to a distance between the positive and negative input traces of the lighting module;

a power driver adapted to supply an output power to a pair of polarized output connectors;

a pair of electrically-conductive fasteners adapted to connect to the lighting module and power driver connectors so as to supply electric power from the polarized connectors to the positive and negative input traces of the lighting module;

wherein the driver and lighting module are attached to opposing sides of the mount member, and the fasteners extend through one of the first or second pairs of spaced apart mounting apertures of the mount member; and wherein the driver has a first footprint shape upon the mount member when the fasteners are disposed through the first pair of mounting apertures, and a second footprint shape upon the mount member when the fasteners are disposed through the second pair of mounting apertures, and the first and second footprint shapes are substantially the same.

16. A lighting fixture as in claim 15, wherein the driver is substantially cylindrical in shape so as to have substantially the same footprint shape even when rotated upon the mount member.

17. A luminaire adapted to be customized to a plurality of configurations, comprising:

a lighting module comprising a body, a plurality of electrically-conductive circuit traces, a positive and negative input trace each being configured to accept a positive and negative electrical input, respectively, and a plurality of light emitting diodes (LEDs) attached to the traces so that electric power from the positive and negative input traces will flow through the LED;

a mount member comprising a lighting module mounting portion and a fixture mount portion, the mount member having a first pair of spaced apart mounting apertures and a second pair of spaced apart mounting apertures, each pair of mounting apertures being spaced a distance generally corresponding to a distance between the positive and negative input traces of the lighting module;

a power driver adapted to supply an output power to a pair of polarized output connectors;

a pair of electrically-conductive fasteners adapted to connect to the lighting module and power driver connectors so as to supply electric power from the polarized connectors to the positive and negative input traces of the lighting module;

wherein the driver and lighting module are attached to opposing sides of the mount member, and the fasteners extend through one of the first or second pairs of spaced apart mounting apertures of the mount member, and a light pattern emitted by the lighting fixture when the module is fastened into place via the first pair of mount apertures is substantially different than a light pattern emitted by the lighting fixture when the module is fastened into place via the second pair of mount apertures.

18. A lighting apparatus, comprising:

a lighting module having:

at least one light emitting diode (LED);

a dielectric member; and a plurality of electrically conductive contacts disposed on the dielectric member, the contacts configured to mount the at least one LED to supply electrical current to the LED;

a mount member having a module receiving portion that engages the lighting module;

a power driver arranged on a side of the mount member generally opposite the lighting module, the driver adapted to receive power and condition the power to a desired state; and a pair of fasteners configured to engage the lighting module and the driver so as to secure the lighting module and driver onto the mount member with the mount member sandwiched between the lighting module and the driver, the fasteners being electrically spaced from the mount member, each of the fasteners comprising an elongate threaded shank and a head;

wherein the power driver comprises connectors that electrically and physically engage the pair of fasteners, the connectors being polarized, and the connectors being fully enclosed within a driver housing;

wherein the fasteners are electrically conductive, and conduct electric power from the driver to a contact of the LED module; and wherein the mount member has a pair of mounting apertures adapted to accommodate insulators and the fasteners so that the fasteners are electrically insulated from the mount member, and the fasteners physically and electrically engage positive and negative input contacts, respectively, of the lighting module.

19. The lighting apparatus of claim 18, wherein the head of a first one of the fasteners is sized and configured to engage the positive input contact of the lighting module, and the head of a second one of the fasteners is sized and configured to engage the negative input contact of the lighting module, and the shanks of the fasteners are sized and configured to engage respective ones of the driver connectors.

20. A lighting fixture, comprising:

a mounting base;

a lighting module comprising at least one light emitting diode (LED), a positive contact, a negative contact, and a mount body, the at least one LED adapted to be powered by electric power flowing between the positive and negative contacts;

a power driver being enclosed within a power driver housing, the power driver adapted to accept an input electric power and condition the input power to create a desired output electric power, the driver comprising a pair of polarized connectors energized with the output electric power, the polarized connectors being being fully enclosed within the power driver housing;

a plurality of fasteners, each fastener having an elongate shank and a head, the heads configured to electrically engage the positive and negative contacts, respectively, so that the fasteners electrically connect the positive and negative contacts of the lighting module to respective polarized connectors of the power driver;

a light modifying apparatus arranged adjacent the lighting module; and a fixture housing at least partially enclosing the lighting module, light modifying apparatus, and at least a portion of the base;

wherein the lighting module and driver are disposed on opposing sides of the mounting base, the mounting base is sandwiched between the lighting module and the driver, and the fasteners physically connect the lighting module, driver, and mounting base.

21. A lighting fixture as in claim 20, wherein the light modifying apparatus comprises a kinoform transform.

22. A lighting fixture as in claim 21, wherein the lighting module comprises a plurality of LEDs, and the light modifying apparatus comprises a plurality of kinoform transforms, and wherein a kinoform transform is arranged generally corresponding to each of the plurality of LEDs.

23. A lighting fixture as in claim 20, wherein the fasteners are electrically insulated from the mounting base.

24. The lighting fixture of claim 20, wherein the module mount body and the mounting base comprise a conductive metal, and the mount body and mounting base engage one another, and the fasteners are electrically insulated relative to the mounting base and the module mount body.

* * * * *